US005089093A

United States Patent [19]

Blatch et al.

[11] Patent Number: 5,089,093

[45] Date of Patent: Feb. 18, 1992

[54] PROCESS FOR CONTROLLING ALUMINUM SMELTING CELLS

[75] Inventors: Geoffrey I. Blatch, Westgarth; Mark P. Taylor, Greensborough; Mark Fyfe, Slengarry, all of Australia

[73] Assignee: Comalco Aluminum Ltd., Georgetown, Australia

[21] Appl. No.: 481,845

[22] Filed: Feb. 20, 1990

[30] Foreign Application Priority Data

Feb. 24, 1989 [AU] Australia ..... PJ2938

[51] Int. Cl.[5] ..... C25C 3/06; C25C 3/20

[52] U.S. Cl. ..... 204/67; 204/225; 204/228; 204/245

[58] Field of Search ..... 204/67, 243 R-247, 204/153.1, 400, 225, 228

[56] References Cited

U.S. PATENT DOCUMENTS

| | | | |
|---|---|---|---|
| 3,573,179 | 3/1971 | Dirth et al. | 204/67 |
| 3,625,842 | 12/1971 | Bristol et al. | 204/67 |
| 3,660,256 | 5/1972 | Lippitt et al. | 204/67 |
| 3,712,857 | 1/1973 | Piller | 204/67 |
| 3,812,024 | 5/1974 | Goodnow et al. | 204/67 |
| 4,425,201 | 1/1984 | Wilson et al. | 204/67 |
| 4,814,050 | 3/1989 | McGraw et al. | 204/67 |

FOREIGN PATENT DOCUMENTS

| | | |
|---|---|---|
| 0044794 | 7/1981 | European Pat. Off. . |
| 2238775 | 2/1975 | France . |
| WO86/05008 | 8/1986 | PCT Int'l Appl. . |

*Primary Examiner*—Donald R. Valentine
*Attorney, Agent, or Firm*—Kenyon & Kenyon

[57] ABSTRACT

A process for controlling an aluminum smelting cell comprising monitoring the cell voltage and current, alumina dumps, additions, operations and anode to cathode distance movements, continuously calculating the cell resistance and the bath resistivity from said monitored cell voltage and current, monitoring the existence of low frequency and high frequency noise in the voltage of the cell, continuously calculating the time rate of change of resistance of the cell, suspending calculation for a predetermined time when an alumina dump, addition, operation or ACD movement occurs, establishing filtered resistance slope thresholds, determining whether the low frequency noise is above a predetermined threshold, and if so, increasing the filtered slope thresholds for low alumina concentration detection, calculating an alumina inventory from the alumina dumps, determining whether the cell is overfed, and if not feeding alumina to prevent an anode affect, calculating the heat supplied and heat required for aluminum production, calculating the heat available for dissipation, calculating the target heat for the cell, calculating the difference between the available heat and the target heat with respect to time, calculating a running heat inventory from the integral of this difference, establishing a target resistance for the cell and modifying that target resistance to achieve a zero heat integral, checking that the target resistance is an allowable value, and moving the anodes of the cell to establish the new target resistance, estimating the time rate of change of bath resistivity and checking whether resistivity and the derivative are greater than predetermined limits, and if so, adjusting the target heat of the cell to maintain the long term heat balance of the cell.

32 Claims, 12 Drawing Sheets

HEAT AND MASS BALANCE CONTROL STRATEGY

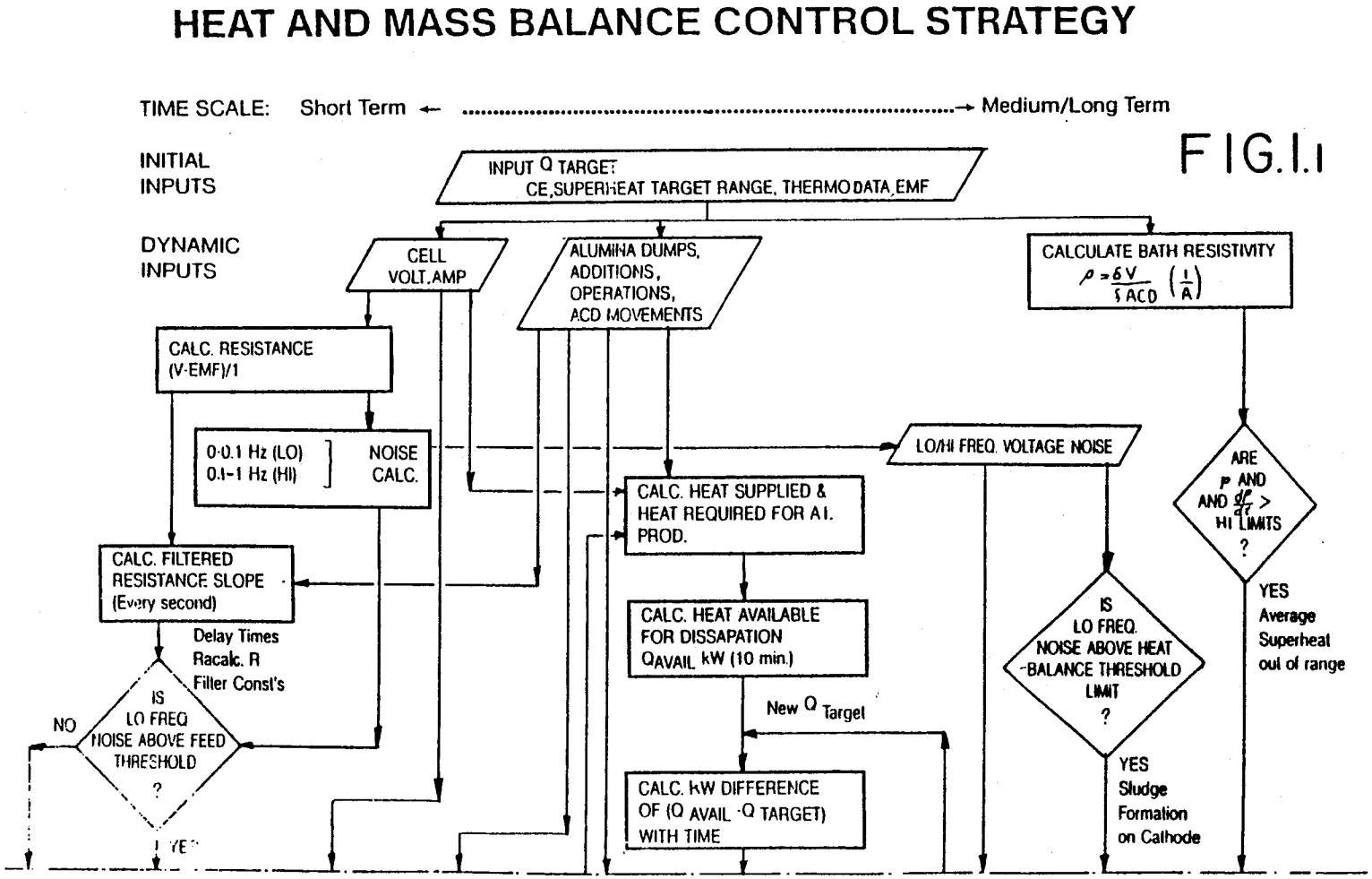
FIG. 1.1

FIG. 2.1
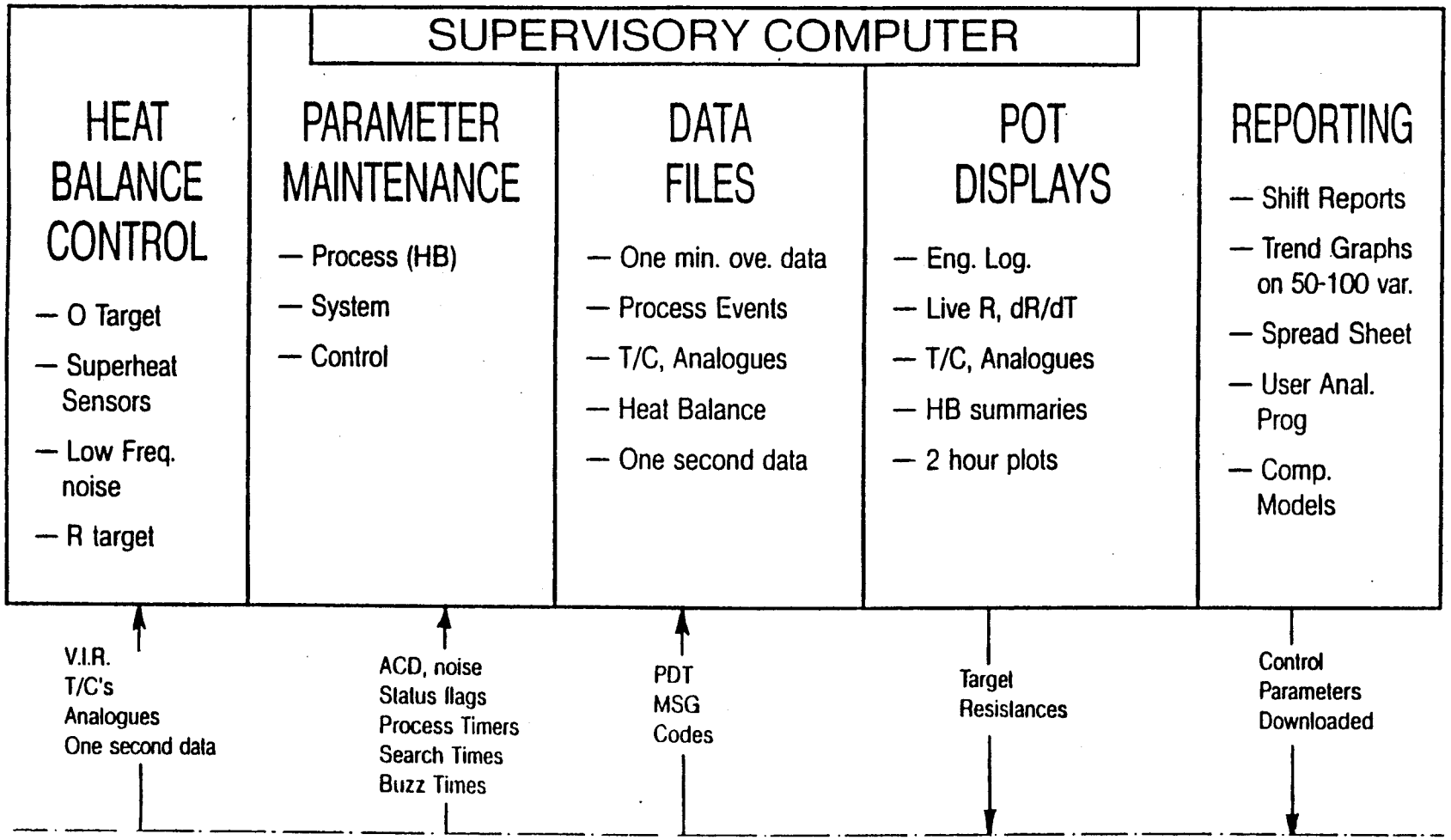

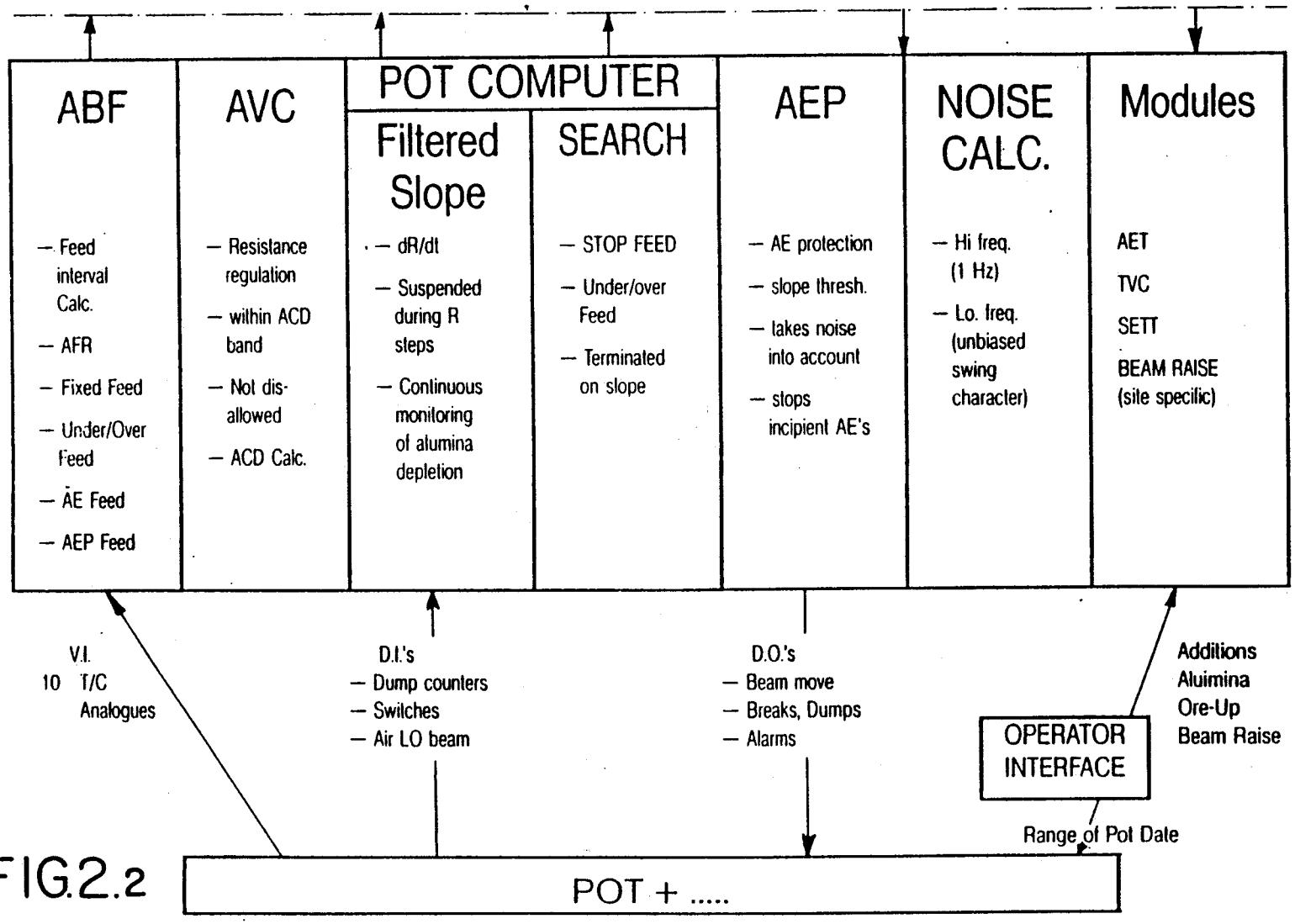
FIG.2.2

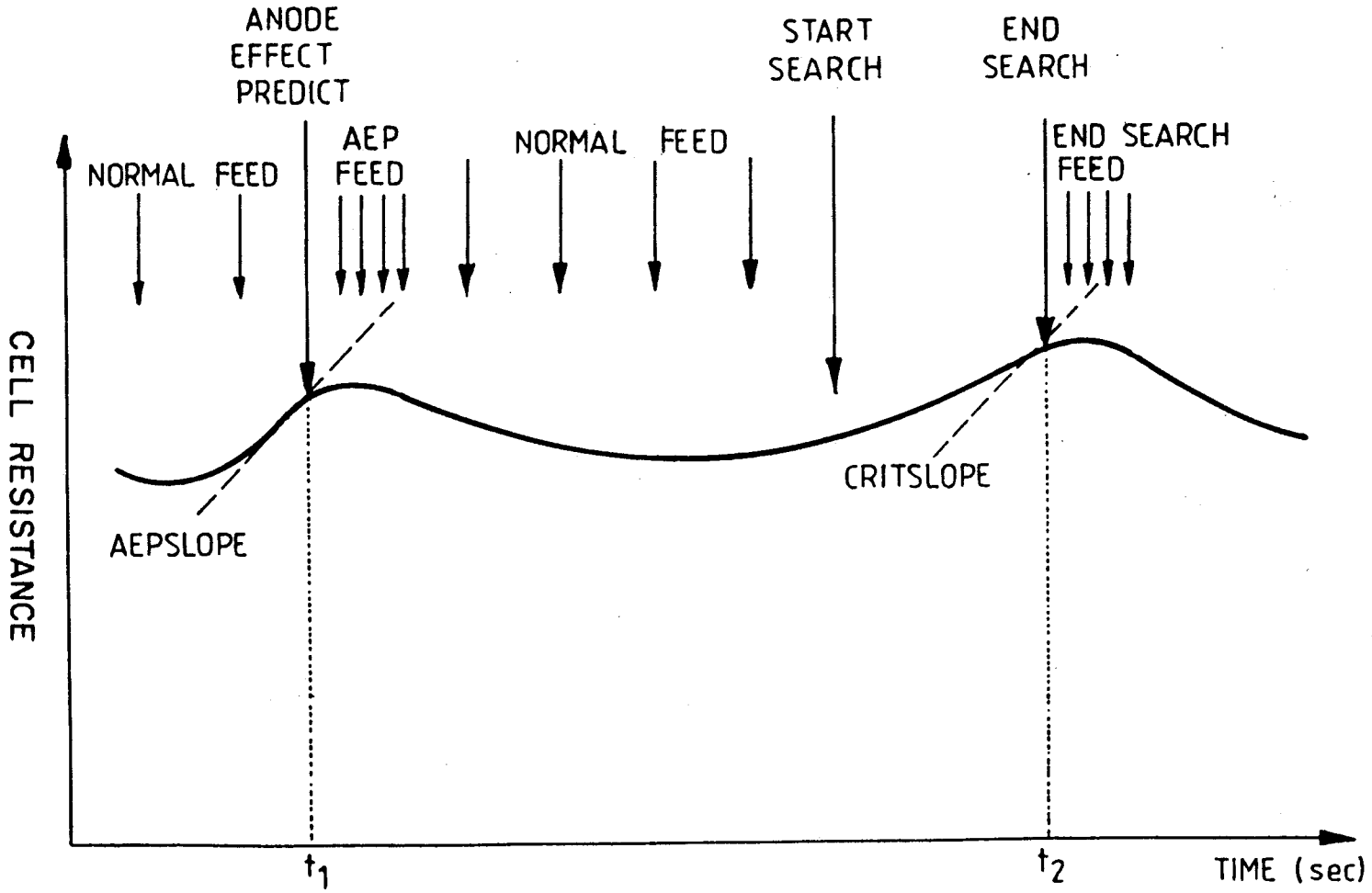
FIG. 3 STOP FEED SEARCH [SFS] and ANODE EFFECT PREDICTION [AEP]

Low Frequency Noise Calculation and Examples

Available Heat, %xsAlF$_3$. Bath Resistivity and Slope of Resistivity

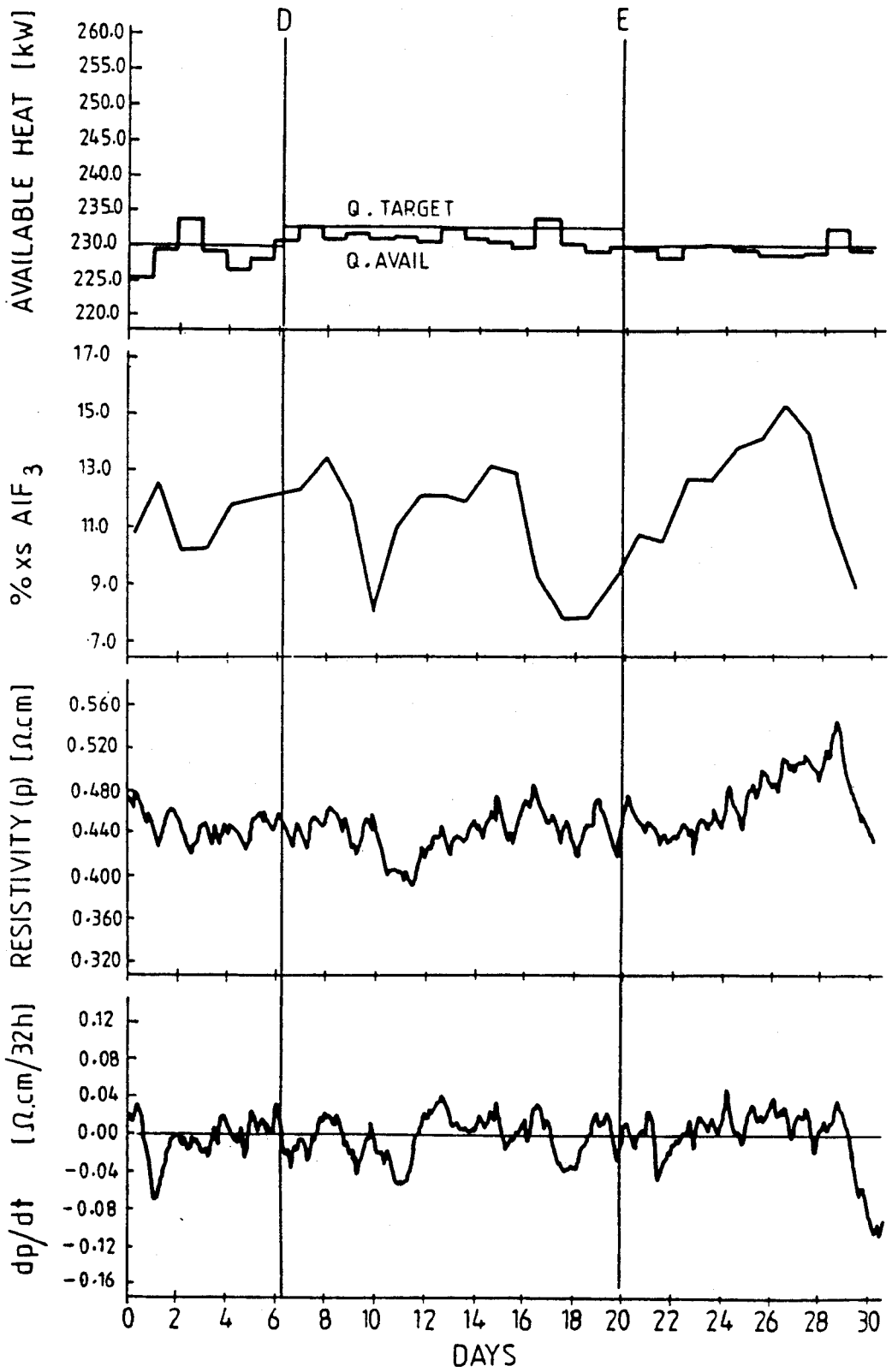
FIG. 5B Available Heat, %xsAlF$_3$. Bath Resistivity and Slope of Resistivity

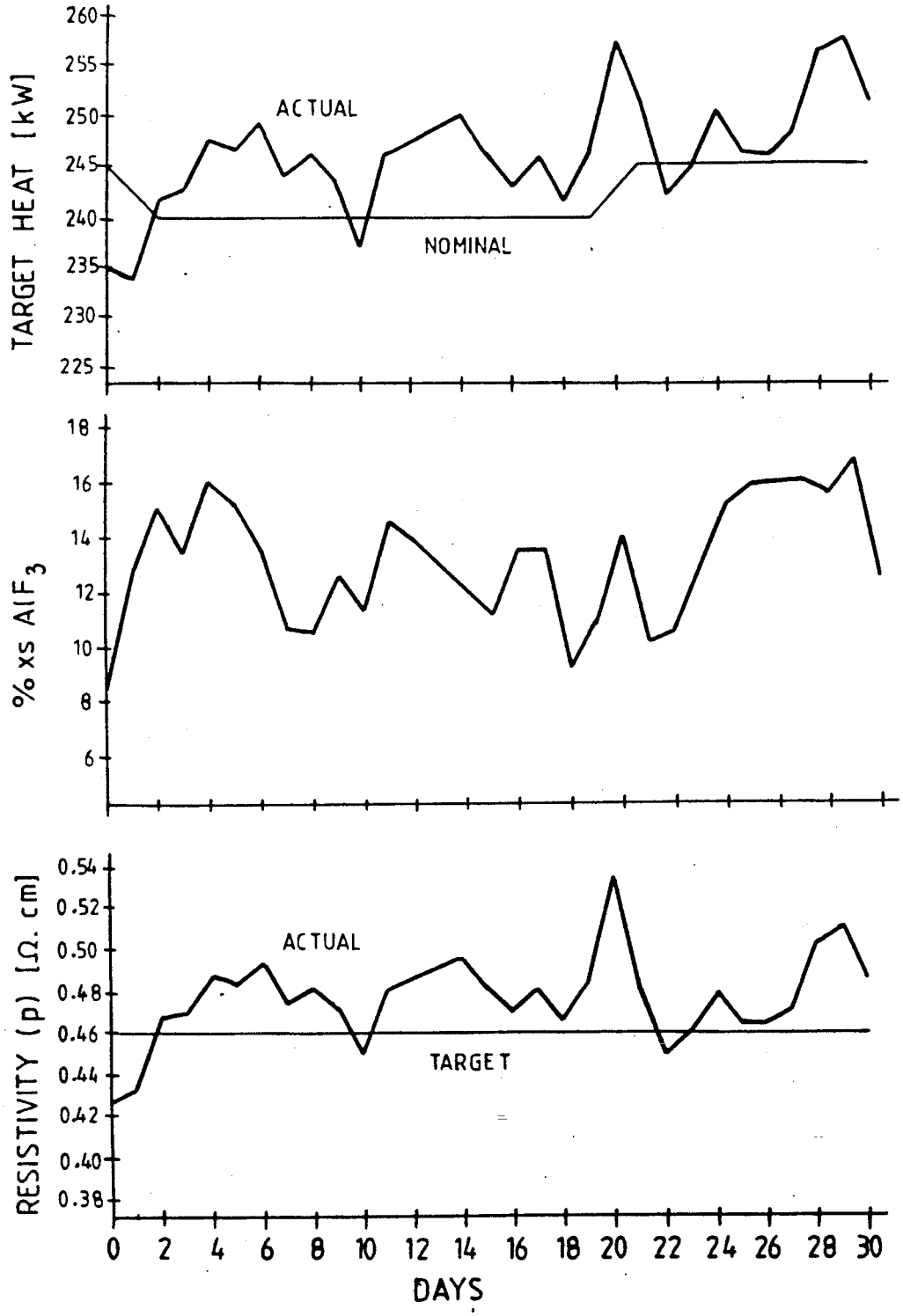
FIG. 5C Target Heat, % xs $AlF_3$, and Bath Resistivity.

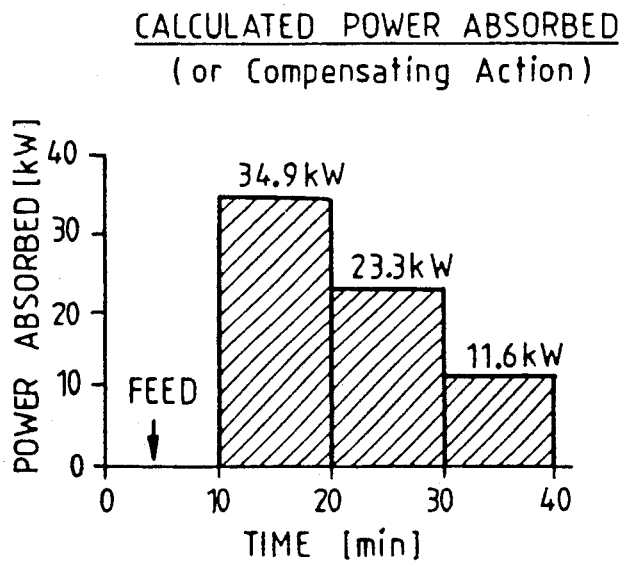
FIG. 6 Calculated Energy Impact (hence compensating action) for Feeding a Cell
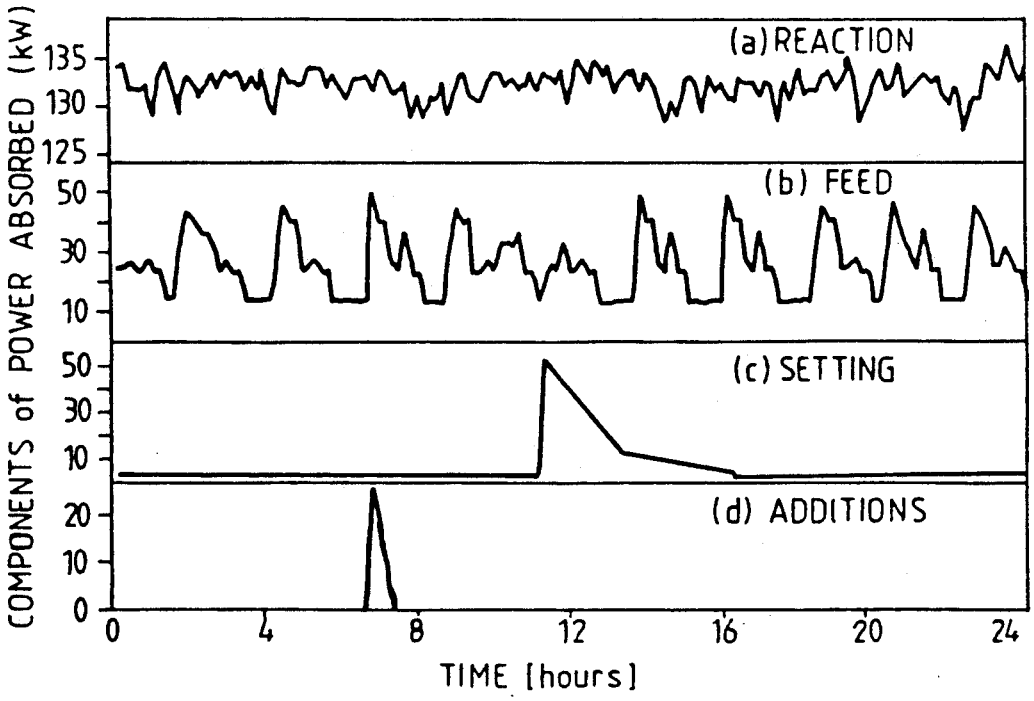
FIG. 7 Breakdown of Calculated Energy Absorbed by Cell over 24 hours

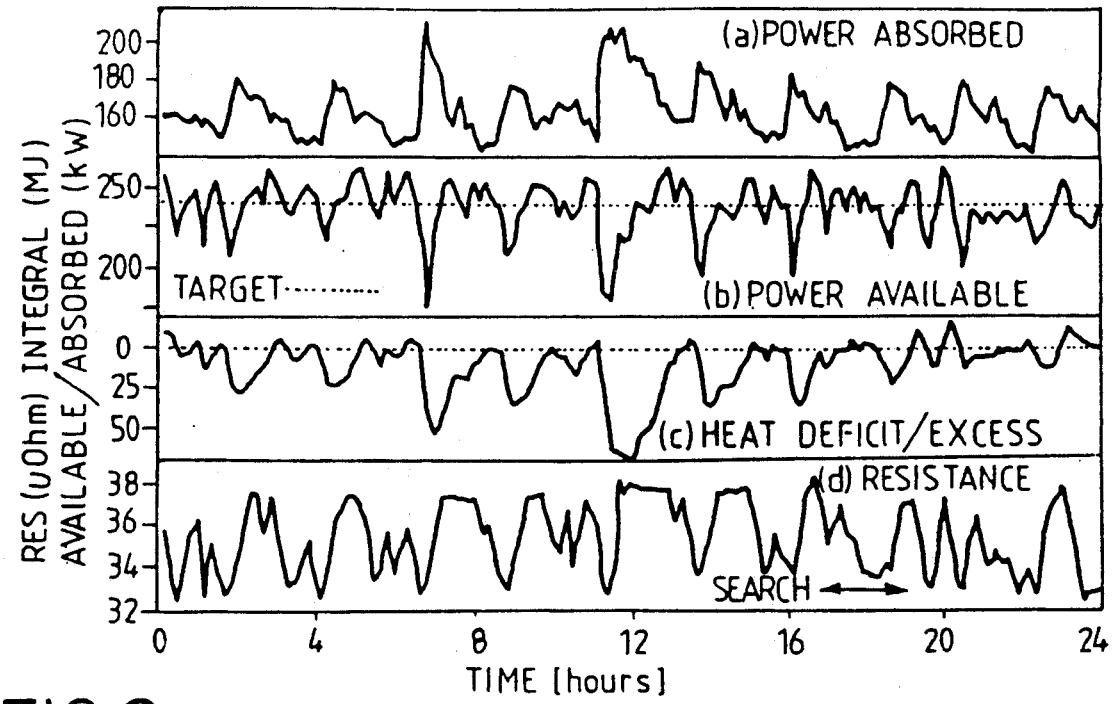
FIG. 8 Control System and Cell Response over 24 hours
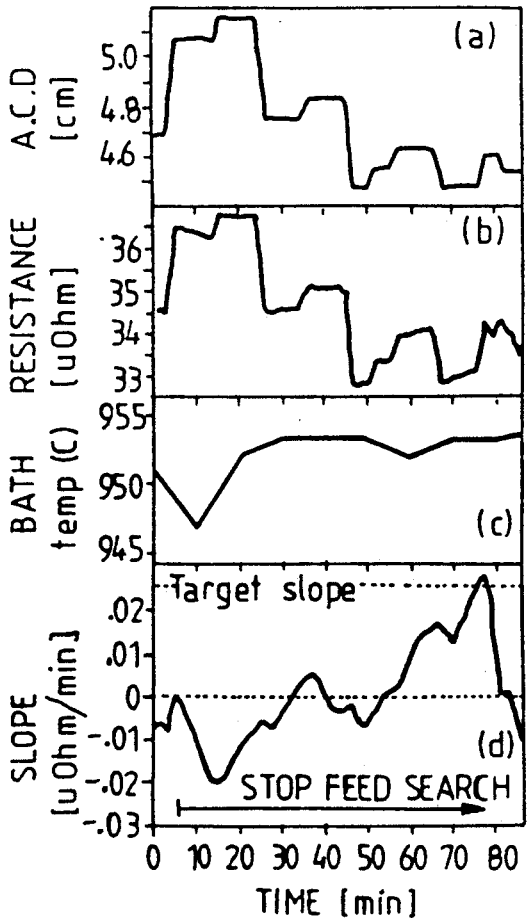
FIG. 9
Detail of Stop Feed Search for Alumina Control

PROCESS FOR CONTROLLING ALUMINUM SMELTING CELLS

FIELD OF THE INVENTION

This invention relates to improvements in the automated control of electrolytic smelting cells for the production of aluminium.

BACKGROUND OF THE INVENTION

The control of electrolytic cells in the production of aluminium is influenced by both short term and long term process parameter changes. In the short term, bath superheat, alumina concentration and anode to cathode distance (ACD) need constant monitoring, while longer term control is required for metal depth and the composition and volume of the electrolyte in the cell. Operating abnormalities also require attention, such as sludging, anode effects and their frequency, and the short circuiting of the current between the anodes and the metal pad.

The complexity of the interrelationships between the dependent and independent variables in the smelting process are illustrated in Chapter 9 of "Aluminium Smelter Technology"-Grjotheim and Welch-Aluminium-Verlag, 1988, and this chapter provides a useful summary of the currently utilised control strategies. This summary and the proliferation of literature on the subject further illustrate the complexity of the problem and the absence of a strategy that provides a satisfactory level of control resulting in constantly high efficiency levels.

Numerous examples of control strategy proposals are also to be found in the patent literature. Recent examples include U.S. Pat. No. 4,654,129 Leroy which describes a process involving periods of over supply and under supply to maintain the alumina concentration in the cell within a narrow range by monitoring the rate of change of the resistance of the cell. This process relies for its success on the use of point feeding of alumina to the cell, and it is not therefore useful for cells without point feeders. Also, since in this strategy it is critical to maintain the alumina concentration within a narrow range, the strategy suffers if the concentration moves outside that range and it is often difficult to restore the system to its optimum operating conditions.

A similar control strategy is described in International Patent Application PCT/NO86/00017 (W086/050008) Aalbu et al. In common with the above U.S. patent, the strategy relies heavily on the rate of change of the resistance of the cell to monitor alumina concentration and does not have regard to other important parameters to control the heat and mass balance of the cell. The disclosure similarly does not address the strategy to be adopted during process events, such as alumina feeding, anode movements, anode setting and tapping.

U.S. Pat. Nos. 4,008,142 and 4,024,034 Doring et al, uses the concept of constant anode-cathode distance to adjust cell resistance according to the known or assumed electrochemical voltage breakdown. Anode-cathode distance adjustment is made in cases where current efficiency (by metal production measurement) is less than expected theoretically. Automatic adjustment of voltage/cell resistance in response to noise on the signal is also indicated. However, no attempt is made to calculate the heat or alumina balances or to make furnace adjustments on this basis, with the exception of adjustment of cell resistance on the basis of long term running metal production figures. This does not constitute a calculation of the energy balance or process energy requirement.

In U.S. Pat. No. 4,766,552 Aalbu et al, the resistance/alumina concentration curve is used to control alumina concentration on point feed cells. A linear model of the cell resistance variation is set up using the resistance slope as a parameter. By fitting the model to continuous resistance measurements, the slope is estimated. However, this strategy does not ensure that the resulting slope is related only to alumina concentration, in fact it assumes this one to one relationship. Anode movement is included in the fitted algorithm and other disturbances are filtered by reducing the gain of the fitting functions when they occur. This procedure is very complex and could be prone to error. In addition, the strategy does not attempt to maintain heat balance within the cell.

In U.S. Pat. No. 4,333,803 Seger and Haupin, a heat flux sensor is used to measure sidewall heat flow. Cell resistance is adjusted to maintain this at a predetermined value. However, this strategy:

1. does not guarantee that heat losses from other portions of the cell are under control (top, bottom);
2. does not react to changes inside the cell on a useful time scale (hours or within a day)—the cell can be significantly out of heat balance before an adjustment is made; and
3. does not provide information about the events/operations occurring in the electrolyte. These events are needed to close the overall energy balance—including the continuous changing process requirements—and to sense the condition of the liquid electrolyte which is where electrolysis is taking place. Effective bath resistivity sensing in the strategy disclosed here allows much faster response to a heat imbalance in the electrolyte.

Other control strategies are described in U.S. Pat. Nos. 3,969,669 Brault and Lacroise, 3,829,365 Chandhuri et al, 4,431,491 Bonny et al, 4,654,129 Leroy, 4,654,130 Tabereaux et al, 3,622,475 Shiver, 3,878,070 Murphy, 3,573,179 Dirth et al, 4,035,251 Shiver and 4,488,117 Seo. This list is by no means intended to be exhaustive.

A primary factor in reduction cell efficiency is the thermal state of the materials in the cell cavity. A control strategy directed at optimizing efficiency should therefore aim to maintain a thermal steady state in the cell. That is, the rate of heat dissipation from the cell cavity should be kept constant. If this is achieved in concert with stable bath and metal inventories, operational stability can be enhanced. The bath superheat will be constant; hence bath volume, chemistry and temperature will be stable due to the absence of ledge freezing or melting. Improved operational stability may allow a cell to be operated with better alumina feed control, at a lower bath ratio, and at a lower time averaged rate of heat loss. This will improve the process productivity.

A major difficulty in maintaining thermal steady state in a reduction cell is the discontinuous nature of various operations. The energy requirements of alumina feeding and dissolution can vary from minute-to-minute, particularly on breaker-bar cells. This is further exacerbated by the deliberate changes in feed rate required by many feed control techniques. Anode setting in pre-baked cells also introduces a large cyclic energy requirement.

Other processes, such as bath additions, anode effects and amperage fluctuations further alter the short-term thermal balance of a cell. Currently available control systems do not address these fluctuating thermal requirements in a comprehensive way. For example, target voltage control has allowed for alumina feeding in some systems. Similarly, anode effects have been used to control the power input. However, the complete range of variable energy requirements are not treated systematically or quantitatively to maintain a constant rate of heat supply available for dissipation through the cell.

SUMMARY OF INVENTION AND OBJECTS

It is an object of the present invention to provide an improved process for controlling aluminium smelting cells in which the heat balance of the cell is comprehensively controlled.

In a first aspect, the invention provides a process for controlling the operation of an aluminium smelting cell, comprising the steps of:

(i) continuously monitoring cell voltage and current, (ii) calculating the resistance of the cell from the monitored cell voltage and current, (iii) calculating the rate of change of cell resistance (resistance slope) and providing a smoothed value of said resistance slope, (iv) utilizing the smoothed resistance slope values to maintain mass balance in the cell, (v) monitoring cell process operations including alumina additions, electrolyte bath additions, anode changes, tapping, beam raising and anode beam movement, (vi) delaying the calculation of resistance slope and smoothed resistance slope for a predetermined time when any one of said monitored cell process operations occurs, and (vii) recalculating said cell resistance slope and smoothed resistance slope after said predetermined time delay so that the smoothed slope is unaffected by process changes with the exception of alumina depletion.

It will be appreciated that the monitored cell process operations cause significant variations in the calculated resistance and the resultant resistance slope such that the latter parameter no longer provides an accurate reflection of the alumina concentration in the cell. By delaying calculation during the process event for a predetermined time sufficient for the resistance value to again become relatively stable, and then recalculating the resistance slope, an 'intelligent' smoothed resistance slope can be obtained, and the electrolyte/alumina mass balance may be maintained notwithstanding the effect of the process operation.

The predetermined time delay will vary having regard to the detected operation since different operations have different effects on the stability of the resistance value. In one particular cell (Type VI design), the following delays have been found to be satisfactory after completion of each operation:

| Operation | Delay |
|---|---|
| ACD change | 60 sec. |
| Alumina feed | 60 sec. |
| Anode set | 120 sec. |
| Beam raise | 120 sec. |

-continued

| Operation | Delay |
|---|---|
| Bath Addition | 300 sec. |

In a preferred form, the resistance of the cell is calculated using a known formula which compensates for the continuously calculated back EMF of the cell, as will be described further below. The resistance values are filtered using digital filtration techniques (e.g. multiple Kalman filters) in a manner which smooths random and higher frequency pot noise while adequately responding to step changes and the resistance disturbances. This filtered resistance is used for automatic resistance control. The resistance slope is calculated from raw (unfiltered) resistance values as described further below and similar digital filtration is used to continuously calculate smoothed resistance slope values.

The smoothed resistance slope is searched for values exceeding a predetermined slope which is chosen to indicate concentration polarisation and alumina depletion. Different forms of alumina search may be used, and these are described in greater detail in the following specification.

The invention also provides a system for controlling the operation of an aluminium smelting cell comprising suitable means for performing each of the steps defined above.

In a second aspect, the invention further provides a process for controlling the operation of an aluminium smelting cell, comprising the steps of:

(a) monitoring the cell voltage and current and calculating the resistance of the cell from the monitored voltage and current, (b) monitoring alumina additions to the cell, monitoring other additions to the cell bath and monitoring operational changes including anode movements, tapping, anode setting and beam raising, (c) continuously calculating the energy absorbed by the process from thermodynamic energy requirements associated with the cell reaction and the events identified in item (b) above, (d) calculating the heat available for dissipation in the cell from the cell voltage and current and from the continuously calculated process energy requirement determined in item (c) above, (e) calculating from the calculated heat available for dissipation in (d) and from a selected target power dissipation, the integral of the difference between the heat available and the target power dissipation with respect to time to provide a running heat inventory or integral, (f) calculating from this heat deficit or surplus in the cell the change in power dissipation required in the cell over a predetermined period to restore heat balance (zero heat integral in item (e)), (g) establishing an initial target resistance for the cell and an allowable band for said target resistance, (h) Calculating the required change in target resistance from the required change in cell power dissipation (item (f)) divided by the square of a moving average of the monitored cell current, (i) altering the target resistance in accordance with the calculated heat inventory (item (e)) and checking that the new target resistance is within said allowable band, and (j) moving the anodes of the cell to achieve said new target resistance.

Preferably alumina concentration control is carried out by continuously calculating the cell resistance, the rate of change of cell resistance and by smoothing the rate of change values to continuously provide smoothed resistance slope values. Base resistance slope and critical threshold slope for the smoothed resistance slope values indicate target and low alumina concentrations respectively.

The above control process will be seen to take account of both the alumina mass balance of the cell and the short term heat balance of the cell simultaneously.

The calculation of resistance slope and smoothed resistance is preferably delayed for a predetermined time, as described further above, when any one of the monitored cell process operations occur. Thus the resistance slope and smoothed resistance slope are recalculated after the predetermined time delay on the basis of a stabilized series of raw resistance values, so that the smoothed slope is unaffected by process changes, with the exception of alumina depletion.

The target power dissipation is preferably adjusted using bath resistivity data. The bath resistivity and the rate of change of resistivity are calculated and used to adjust the target power dissipation of the cell according to cell response characteristics so that the cell resistivity moves into a target range associated with bath composition and volume.

The cell voltage is preferably monitored to determine the existence of low frequency or high frequency noise in the voltage system.

If the low frequency voltage noise is above a predetermined threshold, the target power dissipation is increased in order to remove cathode sludge deposits. The new target power dissipation value is then used in the control of the cell resistance and hence the heat balance of the cell.

The invention also provides a system for controlling the operation of an aluminium smelting cell comprising suitable means for performing each of the steps defined in the second aspect above.

It will also be noted that if low frequency voltage noise is above a predetermined threshold, the smoothed resistance slope thresholds for low alumina concentration are raised. The critical slope threshold for one pot group under test was 0.025 uΩ/min. at voltage noise levels below the noise threshold of 0.25 uΩ/min. When the low frequency noise exceeds the above threshold, the base slope threshold is ramped by an amount proportional to the amount by which the noise signal exceeds the predetermined threshold. The maximum increment of the ramp is 0.05 uΩ/min. and occurs at a low frequency noise level of 0.50/min. The filtered slope is again compared with the incremented threshold and if it is found to be greater than the threshold, the alumina inventory is then considered to determine whether or not the cell is overfed. If this determination is in the negative, the control system instructs a specific form of alumina feeding cycle to be effected—this is either an end of search or an anode effect prediction feeding cycle.

Long term heat balance is achieved in a further control strategy element which causes adjustment of $Q_{TARGET}$, based on the data derived from the resistance measurements monitoring the resistivity of the cell in the manner described in greater detail below.

BRIEF DESCRIPTION OF THE DRAWINGS

A presently preferred embodiment of the invention will now be described with reference to the accompanying drawings in which:

FIG. 1 is a diagrammatic representation of the three control functions and their interactions, as performed by a preferred embodiment of the control system according to the invention;

FIG. 2 is a schematic diagram showing the test control system used on an operational pot;

FIG. 3 is a diagrammatic graph showing one form of alumina concentration search (SFS) and anode effect prediction (AEP) performed by the system embodying the invention;

FIGS. 5A and 5B show bath resistivity and rate of change of resistivity $$\left(\frac{d\rho}{dt}\right)_{Q_{TARGET}},$$

Figure 12:
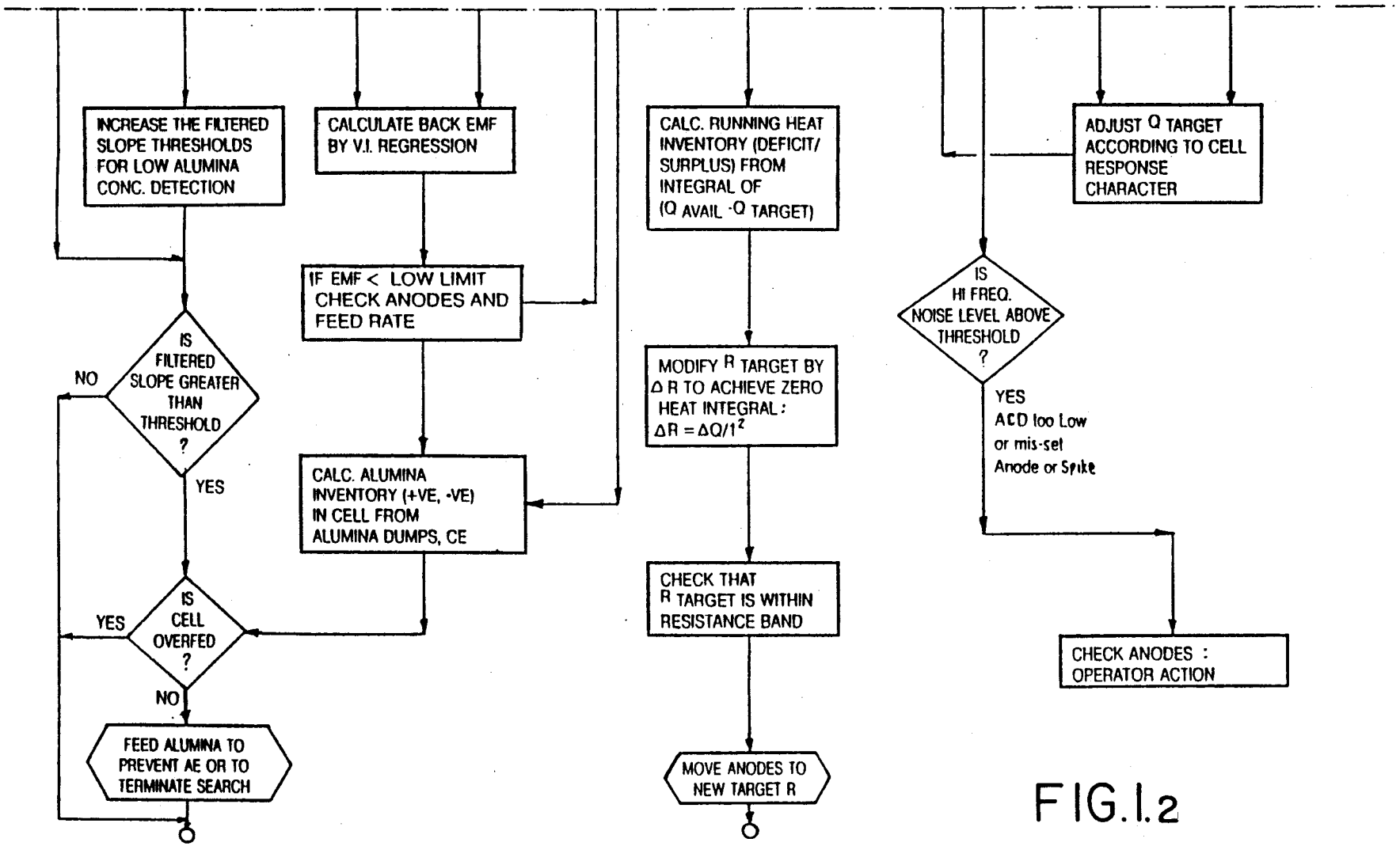

daily mean $Q_{AVAIL}$ and % excess $AlF_3$ of the bath for two consecutive months.

FIG. 5C shows bath resistivity, $Q_{TARGET}$ and % excess $AlF_3$ of the bath over a one month period.

FIG. 6 is a diagram showing the calculated energy impact or process energy requirement (and hence compensating action) for feeding a test cell;

FIG. 7 is an operational diagram showing the breakdown of calculated energy absorbed or process energy requirement in a test cell over 24 hours;

FIG. 8 is an operational diagram showing the test cell response under the control system of the invention over 24 hours, and FIG. 9 shows operational diagrams illustrating the detail of a stop feed search for alumina control of a test cell.

DESCRIPTION OF PREFERRED EMBODIMENT

In the following description, one embodiment of a control system under test on a working cell will be described in some detail. In describing the control system, it will be assumed that the reader is already aware of the operation of an aluminium reduction cell and the standard methods of monitoring cell voltage and current, and the standard methods of calculating the cell resistance. Accordingly these aspects will not be described further in this specification.

Referring firstly to FIG. 1 of the drawings, the control system embodying the invention is shown in simplified flow diagram form. Before proceeding with a detailed description of the control system, a general overview of the system will be provided.

The aim of the control system is to maintain a cell at thermal steady state. That is, the rate of heat dissipation from the cell should be maintained at a constant, target value. For the control system the heat available for dissipation from the cell ($Q_D$, ($k^W$)) may be defined as:

$$Q_D=(V_C-(R_E\times I/1000))\times I-(Q_F+Q_S+Q_A+Q_M) \quad (1)$$

where, $V_C$=cell voltage (V)

$R_E$=metered external resistances (eg rods, buswork) (uOhm)

1=line amperage (kamps)

$Q_F$=alumina dissolution power (kW)

$Q_S$=anode setting power (kW)

$Q_A$=power for A1F3/cryolite heating and dissolution (kW)

$Q_M$=remaining process enthalpy requirements (chemical reaction for metal production) (kW)

'$V_C$', '$R_E$', and 'J' can be measured readily. The various components of the enthalpy of reaction of ($Q_F+Q_S+Q_A+Q_M$) can also be calculated quantitatively using the thermodynamic cycle for reduction of alumina by carbon [see Grjotheim and Welch, Aluminium Smelter Technology 1988 pp 157-161)], the amperage 'I' and a specified current efficiency (CE). Factors such as the carbon ratio and the $AlF_3$ consumption vary significantly between plants. This will alter the calculations used. The enthalpy components presented in Table 1 were calculated for the applicant's Bell Bay smelter.

TABLE 1

BREAKDOWN OF ENERGY/POWER REQUIREMENTS OF SMELTING PROCESS

| ENERGY COMPONENT | REACTION | ENERGY/POWER REQUIRED |
|---|---|---|
| $Q_F$ | $Al_2O_{3(s,\,298K)} \longrightarrow 2Al^{3+}_{(diss,\,T)} + 3O^{2-}_{(diss,\,T)}$ | 1820 kJ/kg $Al_2O_3$ |
| $Q_S$ | $C_{(s,\,298K)} \longrightarrow C_{(s,\,T)}$ | 1380 kJ/kg carbon (310 MJ/anode) |
| $Q_A$ | $AlF_{3(s,\,298K)} \longrightarrow Al^{3+}_{(diss,\,T)} + 3F^{-}_{(diss,\,T)}$ | 1470 kJ/kg $AlF_3$ |
| | $3(NaF)AlF_{3(s,\,298K)} \longrightarrow 3Na^{+}_{(diss,\,T)} + Al^{3+}_{(diss,\,T)} + 6F^{-}_{(diss,\,T)}$ | 1420 kJ/kg cryolite |
| | $Al^{3+}_{(diss,\,T)} + \frac{3}{2}O^{2-}_{(diss,\,T)} + \frac{3}{4x}C_{(s,\,T)} \longrightarrow$ | (0.4352 + 0.01138X)I kW |
| $Q_M$ | $Al_{(l,\,T)} + \frac{3}{4}(2-\frac{1}{x})CO_{2(g,\,T)} + \frac{3}{2}(\frac{1}{x}-1)CO_{(g,\,T)}$ | |

N.B. Current Efficiency = x (%), Line Current = 1 (amps), T = 1293K

Note that the CE specific for the control system was made based on tapping history.

The time over which energy is consumed by an individual process event must be defined in addition to the amount of energy consumed. In the control system this was achieved by distributing the total energy requirement of setting, feed or additions over predefined periods. FIG. 6 illustrates the feed energy distribution for a Bell Bay breaker bar cell. Note that the energy balance was integrated over each 10 minute period and converted to power units.

In addition to the calculations in the previous section, other components were required for the application of the control strategy in practice.

Firstly, the dynamics of the reduction cell and control system meant that maintaining an 'instantaneous' energy balance was not possible. For example, during cell trials the energy absorbed by a cell was calculated over ten minute intervals and anode beam movements were carried out at five minute intervals. Hence responses to events were delayed by up to 15 minutes. Further the rate and range of target resistance changes were limited, and the line current variation for subsequent ten minute periods did not allow accurate elimination of an energy imbalance. As a result, an integral of the power imbalance was used to modify the target resistance of the cell. That is:

$$E_i=(Q_{Di}-Q_T)\times 0.6+E_{i-1}\times c \quad (2)$$

where, $E_i$=integral after with 10 minute interval (MJ)

$E_{i-1}$=integral after (i−1)th 10 interval (MJ)

c=integral decay factor $Q_T$=target heat dissipation (kW)

$Q_{Di}$=heat available for dissipation for ith 10 min. interval (kW)

Cell resistance was increased for $E_i<0$ and reduced for $E_i>0$. Note that a decay factor ('c') was included in Eqn (2). This was a recognition that when an energy imbalance in a cell persisted, the energy balance was partly self-correcting. (ie A cell loses more heat if it gets hotter.)

A second additional component allowed control of the magnitude of the various discontinuous energy responses. This was necessary in order to model the thermal response of the electrolyte to localised disturbances or material additions. For example, the extra heat needed at an anode after setting is supplied to the bath volume throughout the cell and may have deleterious effects elsewhere. Also the process engineer may wish to reduce the amount of anode beam movement by damping the cell response to individual events. As a result, coefficients (range 0 to 1) were introduced to tune the instantaneous calculations (thus system responses). Energy requirements for feed, setting and additions were divided into instantaneous and background (constant) power inputs. The various background power inputs were calculated from:

(1) Feed—line amperage, CE (monthly average).

(2) Additions—line amperage, CE, addition rate per kg of metal (monthly average).

(3) Anode Setting—anode size, number of anodes, setting 'rota'.

The final necessary component of the control system was a feed control technique which permitted regular anode beam movement while monitoring alumina concentration—thereby allowing the cell energy balance to be always under control. Search techniques were developed with these functions, where the target alumina concentration was detected via a continuously calculated slope of resistance. No scheduled anode effects (AEs) were included in the feed control strategy. The associated large, uncontrolled energy inputs to the process would have been in conflict with the control philosophy, and are difficult to compensate for in the thermal balance.

Referring again to FIG. 1 of the drawings, the control system has three basic strings, the first two affecting the short term heat and mass balance of the cell, and the third affecting the medium to long term heat balance of the cell. The control system is implemented using a computer for monitoring the functions of the cell or pot (pot computer), such as a Micromac 6000 computer suitable for the aluminium industry, and a supervisory computer for receiving data from each of a number of pot computers and for instructing the pot computers to perform various functions.

Initial input data to the computers includes target heat dissipation $Q_T$, the specific current efficiency CE for the cell being controlled, the bath resistivity target range for the cell, thermodynamics data, as described in greater detail above, relating to the cell and a 'typical' back emf (EMF) of the cell calculated by regression in a known manner.

The essential operating parameters of the cell are dynamically monitored, and these parameters include: the voltage of the cell V, the current of the cell I, alumina additions, cell bath additions, operations such as anode setting, beam raising, manual alumina addition and oreing up, and anode to cathode distance (ACD) movements. From these dynamic inputs, the resistance (R) of the cell is continually calculated from (V−EMF-)/I, and the cell resistivity $\rho$ is calculated from ($\delta$ R/$\delta$ ACD)A, where A is the estimated area of the anodes in the cell.

CONTROL STRING 1: ALUMINA FEED CONTROL

In the first control string, the pot computer calculates the level of noise in the voltage signal, 0 to 0.1 Hz indicating low frequency noise and 0.1 to 1 Hz indicating higher frequency noise, and further calculates the filtered rate of change of resistance with time (smoothed resistance slope) every second. The basic steps in the filtered slope calculation for each time cycle are:

(i) Raw Resistance Slope Calculation.

Raw slope is calculated from the following equation:

$$S_0=(R_0-R_1)/(\Delta t(1+1/\gamma)) \quad \text{EQ (3)}$$

where $S_0$=raw slope at (t+$\Delta$t)

$R_0$=raw resistance at time (t+$\Delta$t)

$R_1$=single stage filtered resistance at time t $\Delta$t=time interval of resistance polling $\gamma$=filter constant for filtered resistance ($R_1$).

It should be noted that the denominator in EQ (3) above represents the mean age of the filtered resistance ($R_1$).

(ii) Box filter for out of range raw slopes:

The raw slope is checked to determine if it is within the present box filter limits. If this test fails, no further calculations are made in this cycle—the slope value is assumed not to be associated with changes in alumina concentration. In the case of the pot under test, the box filter limits were −2.0 and 2.0 micro-ohms/minute.

(iii) Filtered resistance is recalculated (for use in the next time cycle).

$$R_1=R_1(1-\gamma_1)+\gamma_1 R_0 \quad \text{EQ 4}$$

(iv) A three-stage filter is used to find the filtered resistance slope (called smoothslope). For the ith stage:

$$S_i=S_i(1-\gamma_i)+\gamma_i S_{i-1} \quad \text{EQ 5}$$

where $\gamma_i$ is the pre-set filter constant of the ith stage. In the case of one pot under test, typical filtration constants are 0.100, 0.050 and 0.095 for $\gamma_1$, $\gamma_2$ and $\gamma_3$ respectively.

The above operations adequately filter high frequency noise from the resistance signal to produce a realistic filtered slope (with some lag from the three stage filter). In addition, a delay mechanism (discussed above) is included in the calculations to remove the effects of pot operations on the slope, including:

(i) break and feed (normal cycles, AEP*)
(ii) anode movement
(iii) bath additions
(iv) tapping*
(v) anode setting*
(vi) beam raising*

Slope calculations are stopped during these operations, and for a pre-set period afterwards. Near the end of these delay periods, the first stage filtered resistance ($R_1$) is re-set to the mean of a specified number of raw resistance values. For the cases marked *, $S_1$ to $S_3$ are also zeroed. In the case of the pot under test, the respective delays following each of the above operations are:

i) 60 seconds
ii) 120 seconds
iii) 300 seconds
iv) 10 minutes
v) 120 seconds
vi) 120 seconds Delay periods associated with other operations include: When the pot is put on "manual" for any reason, a delay of 30 seconds is introduced.

When alumina is manually added, a delay of 120 seconds is introduced.

Similarly when oreing-up is performed, a delay of 60 seconds is introduced.

A pre-set delay is also implemented when step ii) of the slope calculation fails to give in-range slopes on a given number of consecutive tests. This is intended to trap the gross resistance disturbances not initiated/expected by the pot computer (e.g. sludging may cause an unpredictable resistance response).

Different cells will require different delays depending on their operational characteristics and specific bath volumes, and the delay involved for each operation will be empirically determined by a skilled operator for input into the pot computer.

Two alumina search techniques are available on the system, stop feed search (SFS) and feed search (FDS). Both techniques terminate search on a threshold value of increasing resistance slope, implying low end point alumina concentrations and both techniques allow heat balance regulation (anode movement) during the search. The special features of each are described below.

i) SES

This technique is essentially a stop feed during which the filtered resistance slope is checked every second for values above the critical slope (critslope) indicating alumina depletion. Once the critical slope is attained on a sufficient number of consecutive readings, search is terminated by initiation of an end of search feed followed by the resumption of the previously nominated cycle (see FIG. 3).

The search can also be terminated (classed an unsuccessful search) under the following circumstances:

Cancelled due to time limitation (max search time).

Cancelled due to anode setting, tapping, oreing-up, bath additions.

Cancelled if cell is switched to MANUAL.

The unique features of the SFS with respect to the present invention are:

1. the ability to monitor and interpret the resistance slope through all phases of the search.
2. the ability to move the anodes freely through all phases of the search.
3. the crit slope in the search is a function of the voltage noise in the cell.

The SFS technique has been applied to both breaker bar and point feed cells.

ii) FDS

This is a more complex search procedure but one which has the potential for fine alumina concentration control on point feed cells. The strategy involves following resistance slope before and during underfeeding and overfeeding periods until a target alumina concentration is achieved.

Figure 4A:
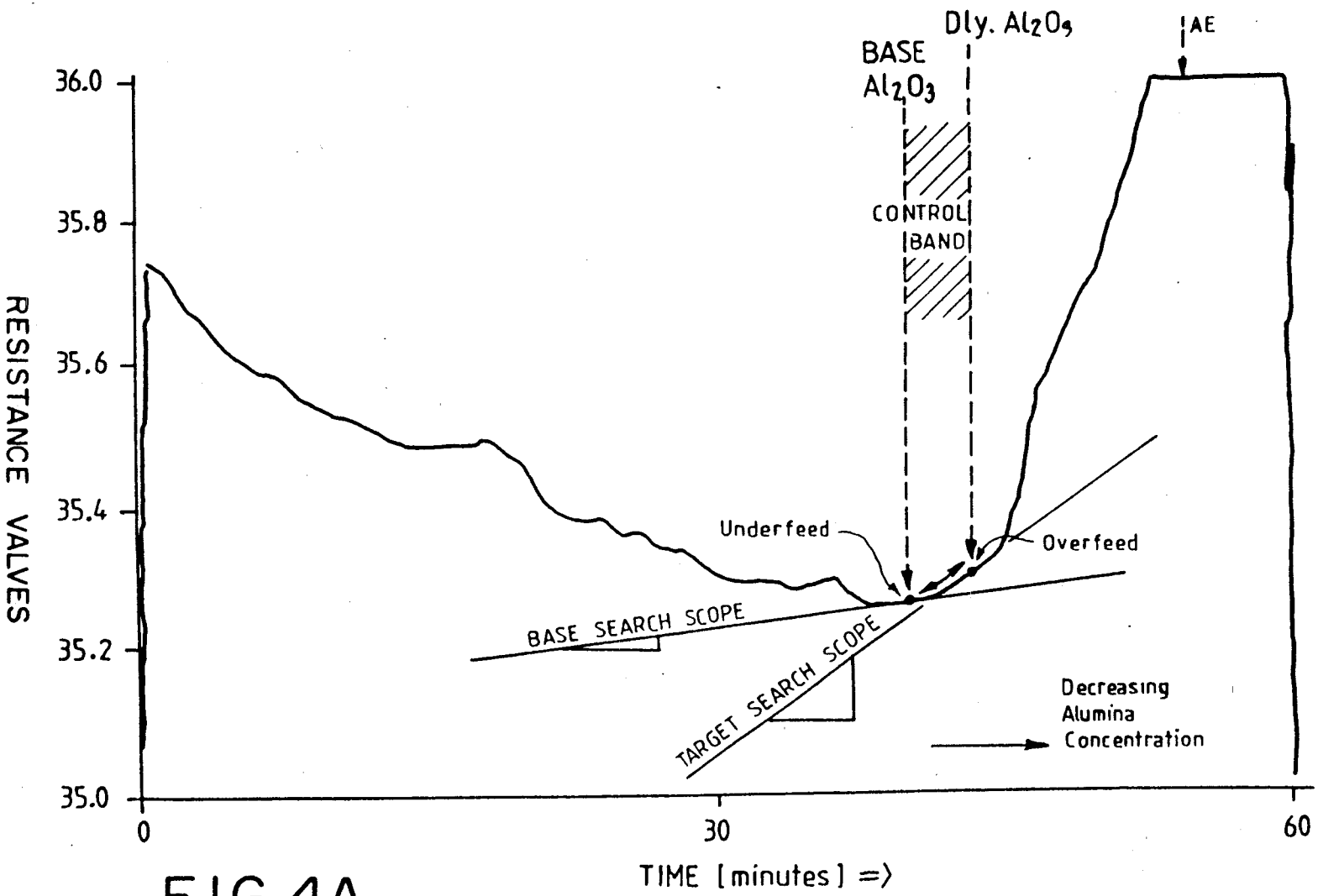
FIG. 4A is an operational graph of resistance values against time showing an alternative method of searching for alumina concentration (namely underfeed/overfeed for point feeders) by the control system embodying the invention.

The stages of the searching routine are as follows:

(a) After commencement of searching, the filtered resistance slope is monitored for a short time period and compared with a parameter, base search slope, near the minimum point on the resistance-time curve in FIG. 4A. The objective is to adjust alumina concentration to this base level.

(b) As the alumina concentration of the cell decreases, the resistance slope increases from a negative value up to the value of the base search slope. Thus slopes more negative than base search slope indicate a higher than 'base-level' alumina concentration and are actioned by changing to x% underfeed. Slopes more positive than base search slope indicate a lower than base-level concentration and cause a y% overfeed cycle to begin.

(c) When the filtered slope passes through base search slope (or the under/overfeeding period times out—whichever is first), a feedrate of x% underfeed is selected for the remainder of the search period.

(d) The filtered slope is then monitored until its value increases positively to target search slope. At this stage the alumina concentration has been adjusted to its target operating level. FDS is terminated and the previously selected (nominal or fixed) feedrate is resumed immediately.

By gradually increasing base search slope towards the target value (target search slope), it is possible to minimize the absolute variation in alumina concentration during FDS under point feeding of alumina. Additionally, if the percent under and overfeed are decreased to small values (such as 10%), the proportion of time spent on search will increase—allowing very close feed control for most of the operation.

ANODE EFFECT PREVENTION MECHANISM

Anode effect prediction (AEP) is provided by a check on the filtered resistance slope every second during normal feeding of the cell (FIG. 3). If it exceeds a pre-set AEP slope an AEP feed cycle is initiated immediately to avoid an anode effect.

This high resistance slope results from the critical depletion of alumina concentration in the cell during periods when alumina searching is not occurring. Resistance changes due to operations like setting, tapping and bath additions are removed by the filtered slope calculation. However, resistance changes due to metal pad instability are included in the filtered slope. Hence the pre-set AEP slope is increased if excessive low frequency noise is detected, as discussed further below, to reduce the likelihood that the system will trigger an AEP feeding cycle due to low frequency noise. It will be appreciated that low frequency, cyclic voltage variations (of less than one cycle per second) are sometimes observed due to instability in the liquid aluminium pad. The rates of resistance increase associated with these cycles can, in the case of severe instability, exceed the resistance slope thresholds above, triggering alumina feeding when this is not warranted. To guard against this occurrence the slope thresholds for both end of search and AEP are increased by a predetermined amount when low frequency voltage noise is detected above a certain amplitude (in micro-ohms). The critical slope threshold for one pot under test was 0.035 uΩ/-min. and the voltage noise threshold was 0.25 uΩ/min. When the low frequency noise exceeds the above threshold, the critical slope threshold is ramped by an amount proportional to the amount by which the noise signal exceeds the predetermined threshold. The maximum increment of the ramp is 0.05 uΩ/min. and occurs at a low frequency noise level of 0.50 uΩ/min. The filtered slope is again compared with the threshold and if it is found to be greater than the threshold, the alumina inventory is then considered to determine whether or not the cell is overfed. If this determination is in the negative, the control system instructs an AEP alumina feeding cycle to be effected. The operation of AEP can also be stopped for a defined period after an AEP prediction as further protection against excessive AEP triggered feeds during periods of cell instability.

Both high and low frequency noise calculations are performed continuously in this module. While the high frequency calculation is a simple 1 Hz, minimum R/maximum R relationship, the low frequency characteristic needs further explanation and this is given below.

LOW FREQUENCY NOISE CALCULATION

Figure 4B:
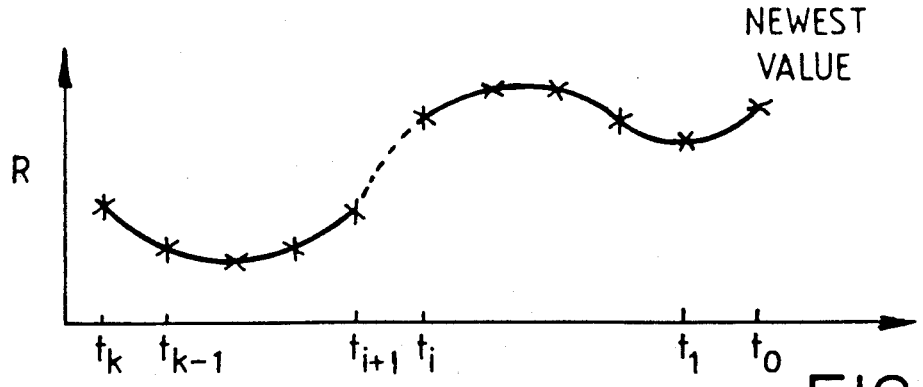
FIGS. 4B to 4E are schematic graphs showing one example of low frequency noise calculation.
Figure 4C:
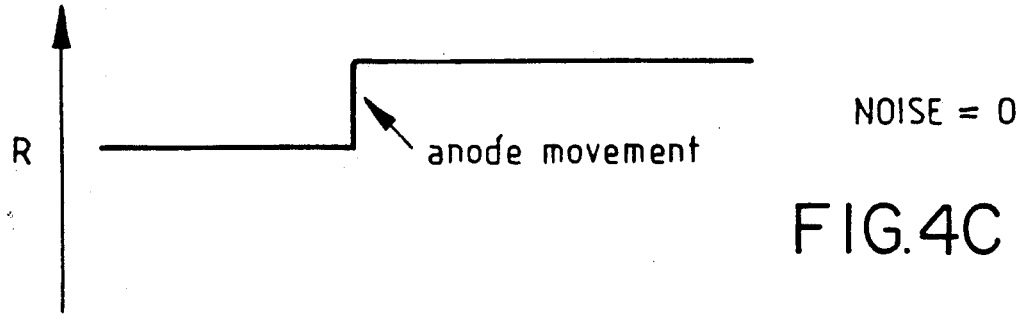
Figure 4D:
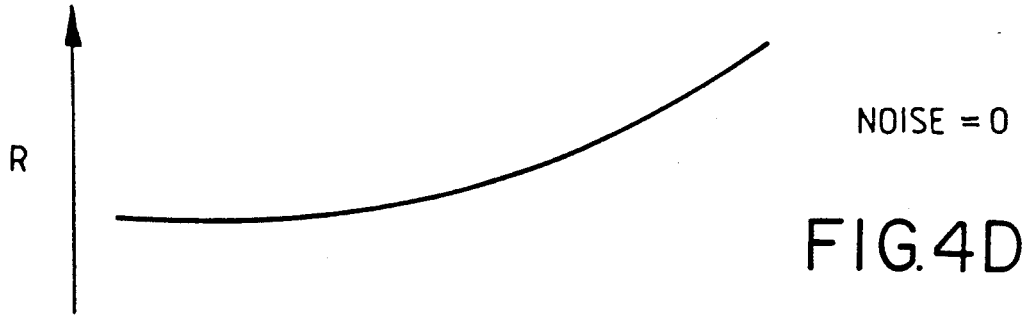
Figure 4E:
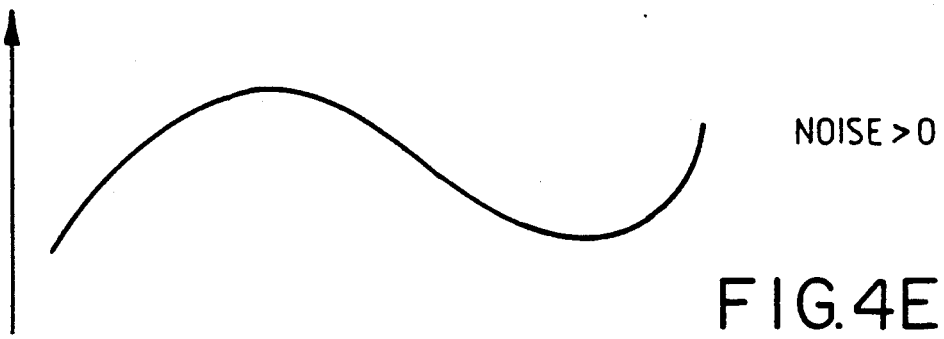

The main function of the low-frequency noise calculation is to detect noise generated by metal pad instability. In this novel formulation, a group of consecutive resistances are summed, then averaged. A ring buffer containing a time sequence of these averages are then stored for some period of time (usually less than 2 AVC periods). FIG. 4B is an example of the resulting data in a computer; essentially it is a resistance vs time plot with the high-frequency noise removed. The low frequency noise is the sum of absolute differences in adjacent resistance averages minus the absolute difference between the newest and oldest averages, divided by the time interval.

i.e. NOISE =

$$\left[\sum_{i=0}^{k-1} |AR_i - AR_{i+1}| - |AR_0 - AR_k|\right] / (t_0 - t_k)$$

where $AR_i$ is the average resistance at time $t_i$ Examples of idealized curves and their noise are shown in FIGS. 4C to E.

The calculation of noise with the addition of each new mean resistance (and the elimination of the oldest resistance) requires less calculation time than standard noise calculations. In the case of one test pot trial the mean resistances are calculated over 10 seconds, and 30 values (5 minutes history) are stored.

CONTROL STRING 2: SHORT RANGE HEAT BALANCE CONTROL

In the second control string the heat supplied and the heat required for aluminium production are calculated from the dynamic inputs described above (cell voltage and current, alumina additions, bath chemistry additions, operations and anode movements) and the heat available ($Q_{AVAIL}$) for dissipation by the cell is also calculated. The difference between available heat and the previously determined target heat ($Q_T$) is integrated with respect to time and from this integral a running heat inventory is calculated. The target resistance ($R_{TARGET}$), derived in the manner described above from $Q_{TARGET}$, is regularly updated on the pot computer to adjust the heat balance of the cell to minimize the imbalance represented by the heat inventory integral. The target resistance must lie between the specified minimum and maximum allowable limits. These limits are, for example, 32–40 uΩ, for a typical pot under test, i.e. a band of about 6 to 8 uΩ. If the average actual resistance over the resistance regulation (AVC) period is significantly different (outside a specified dead band) from the new target resistance, the pot computer then issues a beam raise or lower signal to move the cell resistance back into the dead band. This instruction is limited to a pre-set amount (ΔR max.).

If the updated resistance target consistently falls above or below one of the allowable limits, disallowing the regulation of resistance as described above, the operating amperage, ore cover level, or bath and metal levels are reviewed so that a more flexible region of the operating envelope can be chosen for the cell.

The set point, $R_{TARGET}$, is updated at regular intervals on the basis of short range heat balance calculations. The short range calculations require the following information:

- Real time clock—for scheduling and distributing intermittent power absorbed functions during operations.
- $V_i$, $I_i$, $R_i$—one minute average voltage, current and resistance.
- $P_{CELL}$—Cell Power input (heat balance interval average).
- Current efficiency—based on cumulative metal tap.
- Software switches—indicating commencement of a cell operation.
- Alumina dump counters—metering alumina actually fed to the cell.
- $P_{ABSORB}$—power absorbed calculation This information is used to calculate three parameters:
- $Q_{AVAIL}$—The available power dissipation over the previous period.
- R—The average actual cell resistance over the previous period.
- I—The average cell amperage over a longer time period (default period is one hour).

The calculated value of the available power dissipation is compared to the target value for the cell and the thermal imbalance ΔQ obtained. (The target value ($Q_{TARGET}$) is initially determined from a steady-state computer thermal model prediction and cell operating diagram and then updated imbalance is integrated and converted directly into a ΔR and an $R_{TARGET}$ using the average value of amperage and the previous target resistance respectively.

As mentioned earlier, resistance regulation maintains cell resistance at or near the target value calculated in the heat balance program. Also, as will be discussed, anode movements do not in any way affect the mechanics of feed control on the cell. Functionally, the implications of these strategy requirements are as follows:

i) resistance regulations is prohibited on three occasions only:
during beam raising
during anode setting
during tapping when TVC is operative.

ii) resistance regulation frequency is increased so that the interval between resistance regulation is reduced to five minutes or less.

iii) The proportionally constants for resistance regulation buzz time (decisec/micro-ohm) are set as close as possible to the reciprocal product of resistance/cm of ACD and beam speed (up or down). This ensures that one resistance regulation attempt moves the resistance to its target value—eliminating kilowatt errors from this source.

iv) The dead band for resistance regulation is tight (±0.20 micro-ohm).

CONTROL STRING 3: MEDIUM-LONG RANGE HEAT BALANCE CONTROL

In the final control string, long term heat balance control is used to continually update the target power dissipation $Q_{TARGET}$ through trends in bath resistivity data. This prevents longer term changes in bath thermal conditions and chemistry which occur through breakdown of ore cover, changes in current efficiency or amperage, and variations in anode carbon quality with respect to reactivity, thermal conductivity and anode spike formation.

Bath resistivity data is used to detect all chemistry and thermal conditions in real time.

Bath resistivity is calculated at approximately hourly intervals, using controlled beam movements, with beam movement measured in the usual manner by a shaft counter.

Using the average change in cell resistance before and after the beam movement sequence, bath resistivity is calculated from the known relationship.

$$R_{TOT} = \frac{\rho eff\, ACD}{A_A} + \Sigma R_{FIXED}$$

$$\text{Thus bath resistivity } \rho eff = \frac{\delta R \cdot A_A}{\delta ACD}$$

$\Sigma R_{FIXED}$ is the sum of the contribution of resistance values due to ohmic effects and possible reaction decomposition effects. This value is assumed to be constant for changes in ACD.

$A_A$ is the nominal area of the anode and is assumed to be constant

δACD is measured using the shaft counter

δΔR is the difference between cell resistance before and after the 20 decisecond buss-up.

The bath resistivity and its rate of change is a good indication of the concentration of $AlF_3$. There is a lag time between a rise in % XS $AlF_3$ and a rise in bath resistivity. This characteristic depends on liquid bath volume, anode and cathode condition, and other pot characteristics. Freezing in a cell occurs when the bath super—>heat drops below a certain level and is identifiable by an increase in % XS $AlF_3$. After taking the lag time into consideration, if the bath resistivity is increasing to a level where electrolyte freezing and increases in % XS $Alf_3$ are occurring, the $Q_{TARGET}$ is adjusted in the system so that more power is supplied to the cell. This causes a greater rate of heat dissipation through the electrolyte and increases its superheat, reducing its tendency to freeze. The response must be tuned to the lag time of the resistivity measurement as well as to the $Q_{DISS}$/Superheat relationship, so that $Q_{TARGET}$ does not overshoot its correct value.

The initial or starting value for the target heat dissipation $Q_T$ is derived as follows.

Thermal model calculations (Finite element prediction of isotherms and flows within the cell in question) are used to determine the steady-state level of heat loss required from a particular cell design (e.g. the test pot referred to above is a Type VI cell design and requires 220–230 kW depending on metal level and alumina cover). This target or 'design heat loss' is $Q_{CELL}$.

The process energy requirement for aluminium production can be calculated in a known manner for the cell once the line amperage is known:

$$P_{ABSORB} = P_{CONTINUOUS} + P_{INTERMITTENT}$$

$$= \left\{ \frac{I}{ZF}(a + b \cdot CE) \right\} + \left\{ P_{FEED} + P_{SETTING} + P_{ADDITIONS} + \underset{o \text{ ideally}}{P_{AE}} \right\}$$

In Table 1 this is calculated to be 1.956 Volts×1 at 95% current efficiency (CE) for a typical test cell at Bell Bay (At 90% efficiency this figure is 1.841 Volts×1).

Adding to this the power loss from the bus bar around the cell:

$$R_{EXTERNAL} \times I^2$$

we have the total power input required for the cell:

TABLE 1

| | |
|---|---|
| At I = 87 kA; and 95% CE on Pot under test | $P_{TOTAL}$ = 170.2 kW + 225 kW + 18.2 kW = 413.4 kW; $R_{EXT}$ = 2.4; $Q_{CELL}$ = 225 kW; $V_{ABSORB}$ = 1.956 V |
| | $P_{TOTAL} = P_{ABSORB} + Q_{CELL} + P_{EXTERNAL} = V_{ABSORB} \cdot I + Q_{CELL} + R_{EXTERNAL} \cdot I^2$ |

This power input equates to a cell voltage of $$V_{TOTAL} = P_{TOTAL}/I = 4.75 \text{ V}$$

This cell voltage equates to a target (initial) cell resistance of $$R_{TARGET} = (V_{TOTAL} - 1.65)/I = 35.65 \text{ u}\Omega$$

Typically this resistance will be used as a back-up or start-up value on the pot computer. It will also lie in the mid-range of the allowable target resistance band. Initial Settings are therefore:

$$Q_{TARGET} = 225 \text{ kW}$$

$$R_{TARGET} = 35.65 \text{ u}\Omega$$

However $R_{TARGET}$ will change every ten minutes by R as the $P_{ABSORB}$ term is continuously recalculated according to pot requirements (feeding, anode setting etc.).

Figure 5A:
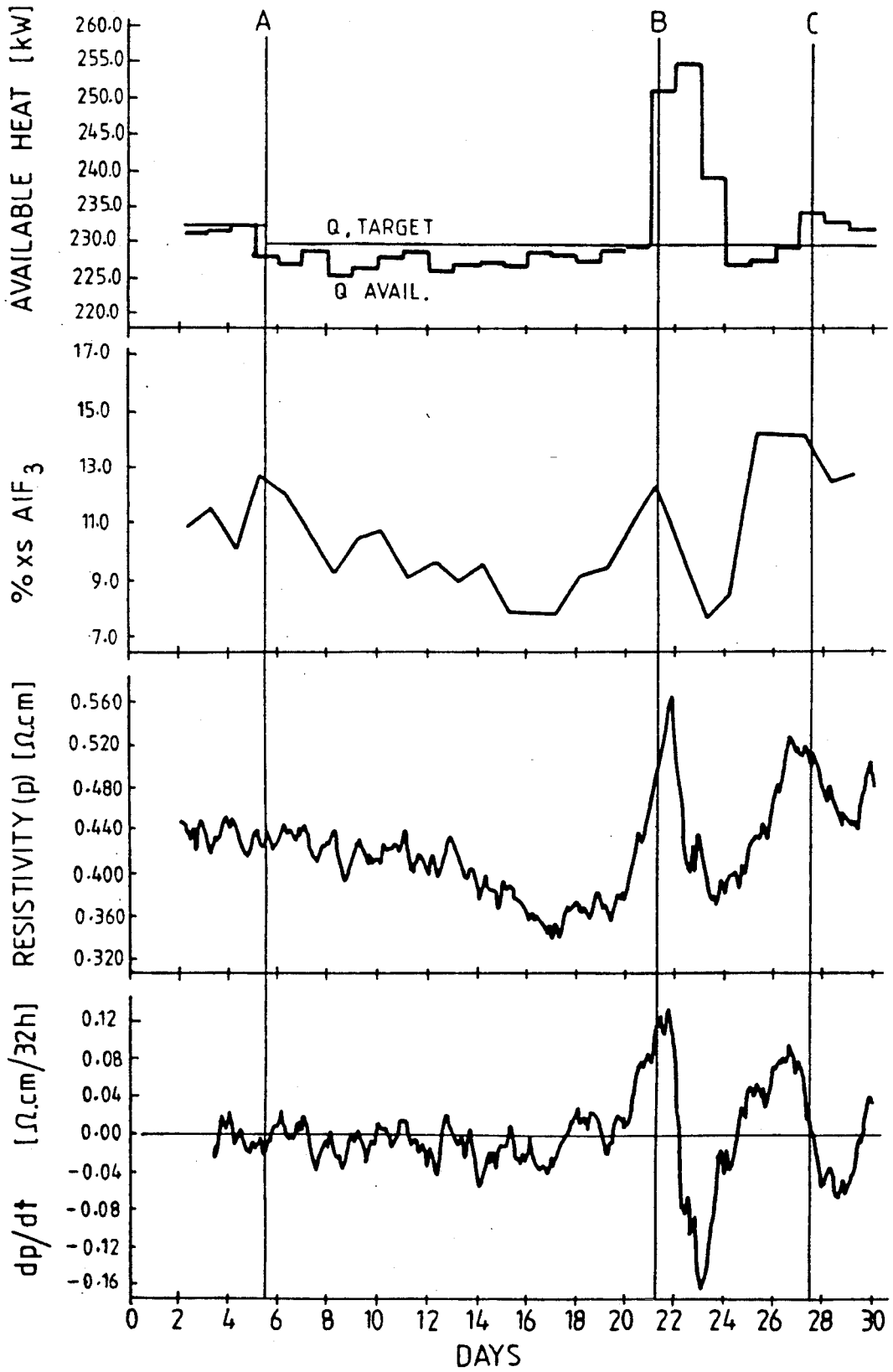

FIGS. 5A and 5B show selected pot parameters over 2 months operation of a reduction cell, with constant $Q_{TARGET}$. The % XS $AlF_3$ varied significantly over this period and $\rho$ and $$\frac{d\rho}{dt}$$

are seen to be good indicators of this. Twice during the period shown, manual increases to the power input were made to increase the cell superheat and reduce the % XS $AlF_3$ (times 'B' and 'C'). In both cases high values of $\rho$ and $$\frac{d\rho}{dt}$$

were evident before manual intervention.

Such observations resulted in the development and testing of a closed-loop control system in which the target energy input to the cell ($Q_{TARGET}$) was changed based on $\rho$ and/or $$\frac{d\rho}{dt}.$$

For the 1 month period in FIG. 5C control of $Q_{TARGET}$ was based on $\rho$ only. (Both the manually set 'nominal' $Q_{TARGET}$ and 'actual' $Q_{TARGET}$ are shown in this Figure.) Note that the high % XS $AlF_3$ on days 4, 11, 19 and 29 correspond with high $\rho$ values. The resultant increased power inputs controlled the high % XS $AlF_3$ excursions, making manual intervention unnecessary.

SYSTEM TESTING

Frequent $V_{AVC}$ action maintains the actual resistance close to the continually updated target value, and the magnitude of its allowable resistance changes are specified as a heat balance parameter—within absolute resistance limits as discussed earlier. More importantly, AVC will not be disallowed during operations unless it is physically unreasonable to perform beam movement. These occasions are during tapping, anode setting and beam raising.

An extended trial of the above described control system has been made on a group of cells at one of the applicant's smelters. For the trial the CE and '$Q_T$' for each cell were selected based on long-term data computer modelling and cell condition. It should be noted that cell condition fluctuates due to factors such as cell ore cover, seasonal temperatures, alumina properties, bath composition and cell age. Hence the parameters should be updated on a regular basis.

Calculation of the power absorbed for the control system used the following hardware inputs:

- voltage and amperage (1 Hz)
- a switch to indicate anode setting (at cell)
- keyboard input for bath additions in kg (adjacent to cell)
- keyboard input for manual alumina addition and ore-ing-up The results presented in FIGS. 7 and 8 show the behaviour of a cell under the control system over 24 hours.

FIG. 7 shows the calculated heat absorbed by the cell, broken down into it's four operational components. Fluctuations in the power required for reaction (metal production) (FIG. 7*a*) were due to line amperage variations. The power absorbed by alumina feeding (FIG. 7*b*) had a strong cyclic pattern. This pattern is accentuated because the alumina searches (SFS) included cessation of feeding (for the day shown). FIG. 7*c* shows the effect of replacing two anodes. For setting, the energy distribution was spread over 5 hours; this was based on trial data and computer modelling of the heat absorbed by the new blocks. FIG. 7*d* includes the energy input for a 15 kg bag of A1F3. Note that 50% of feed power, 50% of setting power, and 20% of the additions power were supplied as constant background inputs, while the remainder in each case was triggered by the respective events.

The calculation of the total absorbed energy is shown in FIG. 8*a*. FIG. 8*b* shows the power available for dissipation from the cell as heat (Eqn 1). Note the target dissipation rate of 240 kW for this cell. The target and calculated actual heat dissipation clearly show the heat deficit/excess in FIG. 8*c*. The cell had an energy imbalance for periods up to 2 hours. This was primarily due to the power input constraints imposed by the cell resistance control band. FIG. 8*d* shows the control band of 32.5 to 38 uOhm used over the 24 hour period. Anode beam movements are clearly larger, and more frequent, than for control systems previously reported in the literature. This reflects the extent of thermal disturbance which is imposed on most reduction cells in a single day.

FIG. 9 illustrates the behaviour of the alumina feed control component of the system during a typical, successful stop feed search (SFS). (The search period is marked in FIG. 8*d*.) One minute averages of anode cathode distance (ACD), cell resistance and slope of resistance are shown. The centre channel bath temperature, measured at ten minute intervals, is also presented. The change in ACD was transduced using the rotation shaft counter (proximity switches) on the anode beam drive shaft. The resistance slope (FIG. 9*d*) was zeroed at the start and end of the SFS; the end of search slope was 0.025 uOhm/min. The search lasted approximately 90 minutes, and there was substantial beam movement throughout. The high resistance/ACD at the start of searching was due to the energy requirement of a 23 kg alumina feed immediately beforehand. Once this energy was supplied, the control system reduced the power input. The control approach allowed long SFSs to be scheduled without the bath temperature or superheat increasing substantially. This allowed back-feeding and depletion of alumina to the target level. The stable bath temperature is clearly shown in FIG. 9*c*, although there was a temperature fall caused by the feed before SFS. Typically, a bath temperature change of only +/−4 C was measured during SFS. While there is some fluctuation in the dynamics of the resistance slope, the underlying trend and threshold values were reliable. The SFS technique achieved good feed control, consistently, with [0.3 AEs/day.

The trial results demonstrate a number of inherent advantages in the control system. Since the energy requirements were calculated from basic information (e.g. line amperage, alumina dumps, thermodynamic data), changes to the operating environment were catered for automatically. If a variation in potline amperage occurred, the control system automatically adjusted the resistance targets of the cell. The mean resistance at which the cell operated over longer periods were also varied if the long-term amperage was changed. Similarly, any decision to change the number of dumps for each feed, the timing of SFSs or the number/size of anodes set was catered for easily. Fundamentally, this was due to the control system being based on the real operating target and component energy requirements of the smelting process rather than the loss direct measures of target voltage or resistance. This same mechanistic approach can also reinforce the understanding of the process for those operating it.

There are, of course, some practical constraints imposed on the control system by the process. If the potline amperage is reduced significantly for a sufficient period, each cell will experience a substantial energy deficit. Thus all cells in the potline will attempt to operate at their maximum target resistance simultaneously. The potline voltage may then exceed the rectifier limits. This problem can be overcome by including safety factors in the control system which limit the closure of energy balance attempted under extreme potline conditions. On an individual pot basis there may also be variations in heat dissipation, current efficiency and the integrity of the top cover/crust, requiring individualization of the $Q_T$ targets for each cell.

The control system embodying the invention maintains a target rate of heat loss from a reduction cell via calculation of the energy absorbed by the process. The trial results show that the system made regular anode beam movements while maintaining good thermal balance on the cell. The control system described here is a building block for the optimization of reduction cell efficiency via understanding and reducing variations in the cell thermal balance.

The overall configuration of a typical control system is shown in FIG. 2. The physical location of each control module on the system in this implementation has been determined by the computing power available at the pot computer and supervisory computer levels respectively. Thus the more complex heat balance control module has been placed on a Microvax supervisory computer. This also has the advantage of providing an interactive human interface to the control function for diagnostics and further development. As a general strategy, however, all essential control functions in a distributed potline system should be located at the lowest intelligent level—the pot computer in this case—so that maximum safety and redundancy can be built into the system.

The computer control functions detailed in FIG. 2 will be recognised by persons of skill in the art and since many of the functions are not critical to the invention, they will not be further described in this specification.

We claim:

1. A process for controlling the operation of an aluminum smelting cell, comprising the steps of:
(i) continuously monitoring cell voltage and current,
(ii) calculating the resistance of the cell from the monitored cell voltage and current,
(iii) calculating the rate of change of cell resistance (resistance slope) and a smoothed value of resistance slope, by calculating a raw resistance slope, checking to determine whether the raw slope value falls within predetermined limits, rejecting any values falling outside such limits, and calculating a filtered resistance slope;
(iv) maintaining the mass balance in the cell by utilizing the smoothed resistance slope values,
(v) monitoring cell process operations, including alumina additions, electrolyte bath additions, anode changes, tapping, beam raising and anode beam movement,
(vi) delaying the calculation of resistance slope and smoothed resistance slope for a predetermined time when any one of said monitored cell process operations occurs, and
(vii) recalculating said cell resistance slope and smoothed resistance slope after said predetermined time delay so that the smoothed slope is unaffected by process changes with the exception of alumina depletion.

2. The process of claim 1, wherein step (iv) includes the step of searching the smoothed resistance slope for values exceeding a predetermined slope chosen to indicate alumina depletion.

3. The process of claim 1, wherein said raw resistance slope is calculated at high frequency.

4. A process for controlling the operation of an aluminum smelting cell, comprising the steps of:
(i) continuously monitoring cell voltage and current;
(ii) calculating the resistance of the cell from the monitored cell voltage and current;
(iii) calculating the rate of change of cell resistance (resistance slope) and a smoothed value of said resistance slope;
(iv) maintaining the mass balance in the cell by utilizing the smoothed resistance slope values;
(v) monitoring cell process operations including alumina additions, electrolyte bath additions, anode changes, tapping, beam raising and anode beam movement;
(vi) delaying the calculation of resistance slope and smoothed resistance slope for a predetermined time when any one of said monitored cell process operations occurs,
(vii) recalculating said cell resistance slope and smoothed resistance slope after said predetermined time delay so that the smoothed slope is unaffected by process changes with the exception of alumina depletion, and
(viii) contiuously monitoring said cell voltage or resistance to determine the existence of low frequency noise in the voltage signal, determining whether said low frequency voltage noise exists above a predetermined threshold, and increasing the smoothed resistance slope threshold in the event that said low frequency noise is above said predetermined threshold.

5. The process of claim 4, wherein said smoothed resistance slope threshold is increased along a ramp having a maximum increase in resistance slope threshold not exceeding a predetermined value.

6. The process of claim 4, wherein said low frequency noise has a frequency less than 0.1 Hz.

7. A process for controlling the operation of an aluminium smelting cell comprising the steps of:
(a) maintaining the mass balance of the cell at a predetermined level by calculating and monitoring a smoothed rate of change of the resistance of the cell to detect a predetermined slope threshold indicative of low alumina concentration in the cell, and
(b) maintaining the heat balance of the cell by
(i) calculating a target heat dissipation for the cell;
(ii) calculating the heat available for dissipation by the cell;
(iii) calculating a running heat inventory from the integral of the heat available minus the target heat, and
(iv) modifying a target resistance value for the cell to achieve a substantially zero heat integral in step (iii) by moving the anodes of the cell to achieve said new target resistance.

8. The process of claim 7, further comprising monitoring cell operations including alumina dumps, cell bath additions, process operations and anode movements and delaying the calculation of the smoothed rate of change of resistance in the cell for a predetermined time when any one of said cell operations takes place, and recalculating said smoothed resistance slope after said predetermined time delay so that said smoothed slope is unaffected by process changes with the exception of alumina depletion.

9. The process of claim 7, wherein the voltage or resistance of the cell is monitored to detect the presence of low frequency noise in the voltage signal, and in the event that the low frequency noise in the voltage signal is above a predetermined threshold, the slope threshold for low alumina concentration detection is increased by a predetermined amount.

10. The process of claim 9, wherein said low frequency noise has a frequency less than 0.1 Hz.

11. The process of claim 7, wherein the resistivity of the cell bath is calculated and the resistivity and rate of change of resistivity with time are monitored to detect values greater than predetermined limits indicative of the cell superheat being out of range, and adjusting the target heat dissipation of the cell to return the cell super-heat to within a predetermined range.

12. The process of claim 9, further comprising the step of determining whether the low frequency voltage noise in the cell is above a predetermined threshold, and if so increasing the target power dissipation in the control of the heat balance of the cell to remove cathode sludge deposits.

13. The process of claim 7, wherein said raw resistance slope is calculated at a high frequency.

14. A process for controlling the operation of an aluminium smelting cell, comprising the steps of:
(a) monitoring the cell voltage and current,
(b) monitoring alumina additions to the cell, monitoring other additions to the cell bath and monitoring operational changes such as anode movements, tapping, anode setting and beam raising,
(c) continuously calculating the resistance of the cell,
(d) continuously calculating the rate of change of cell resistance, and smoothing the rate of change values so calculated to continuously provide smoothed resistance slope values, (e) continuously monitoring cell voltage or resistance to determine the existence of low frequency noise in the voltage signal, (f) continuously calculating the energy absorbed by the process from thermodynamics and the events identified in item (b) above, (g) calculating the heat available for dissipation in the cell from the cell voltage and current and from the continuously calculated process energy requirement determined in item (f) above, (h) establishing a base threshold and a critical threshold for said smoothed resistance slope value indicating target and low alumina concentrations respectively, (i) determining whether low frequency voltage noise exists above a predetermined threshold and increasing the smoothed resistance slope threshold in the event that said low frequency voltage noise is above said threshold, (j) calculating the alumina inventory of the cell from the monitored alumina additions, (k) determining whether the smoothed resistance slope is greater than the predetermined threshold and if so determining whether the cell has been overfed from the calculated alumina inventory, and if not causing an alumina feed to occur, (l) calculating from the calculated heat available for dissipation and from a selected target power dissipation, the integral of the difference between the heat available and the target power dissipation with respect to time, (m) calculating from this heat deficit or surplus in the cell the change in power dissipation required in the cell over a predetermined period to restore heat balance (zero heat integral in item (l)), (n) establishing an initial target resistance and an allowable band for said target resistance, (o) Calculating the required change in target resistance from the required change in cell power dissipation (item (m)) divided by the square of the moving average of the cell current, (p) altering the target resistance in accordance with the calculated heat inventory (item (o)) and checking that the new target resistance is within said allowable band, and (q) moving the anodes of the cell to achieve said new target resistance.

15. The process of claim 14, further comprising the step of monitoring the resistivity of the cell bath and the rate of change of said resistivity with respect to time to detect values greater than predetermined limits indicative of cell superheat being out of range, and adjusting the target heat dissipation of the cell to return the cell superheat to within a predetermined range.

16. The process of claim 11 or 15, wherein said bath resistivity is measured by measuring the resistance of the cell over a predetermined period, adjusting the anode to cathode distance by a predetermined amount, measuring the resistance of the cell over a predetermined period, and calculating the resistivity of the bath from the formula:

$$R_{TOT} = \frac{\rho\text{eff}\, ACD}{A_A} + \Sigma R_{FIXED}$$

Thus wherein bath resistivity $\rho\text{eff} = \frac{\delta R \cdot A_A}{\delta ACD}$

17. The process of claim 14, wherein said raw resistance slope is calculated at a high frequency.

18. The process of claim 14, wherein said low frequency noise has a frequency less than 0.1 Hz.

19. A system for controlling the operation of an aluminum smelting cell comprising:

(i) means for continuously monitoring cell voltage and current, (ii) means for calculating the resistance of the cell from the monitored cell voltage and current, (iii) means for calculating the rate of change of cell resistance (resistance slope) and a smoothed value of said resistance slope, (iv) means for utilizing the smoothed resistance slope values to maintain mass balance in the cell, (v) means for monitoring cell process operations including alumina additions, electrolyte bath additions, anode changes, tapping, beam raising and anode beam movement, (vi) means for delaying the calculation of resistance slope and smoothed resistance slope for a predetermined time when any one of said monitored cell process operations occurs, and (vii) means for recalculating said cell resistance slope and smoothed resistance slope after said predetermined time delay so that the smoothed slope is unaffected by process changes with the exception of alumina depletion, (viii) said means for continuously monitoring said cell voltage or resistance being utilized to determine the existence of low frequency noise in the cell voltage signal, and (ix) means for determining whether said low frequency voltage noise exists above a predetermined threshold, and increasing the smoothed resistance slope threshold in the event that said low frequency voltage noise is above said threshold.

20. The process of claim 19, wherein said low frequency noise has a frequency less than 0.1 Hz.

21. A system for controlling the operation of an aluminium smelting cell comprising:

(a) means for maintaining the mass balance of the cell at a predetermined level by calculating and monitoring a smoothed rate of change of the resistance of the cell to detect a predetermined slope threshold indicative of low alumina concentration in the cell, and (b) means for maintaining the heat balance of the cell including (i) means for calculating a target heat dissipation for the cell;

(ii) means for estimating the heat available for dissipation by the cell;

(iii) means for calculating a running heat inventory from the integral of the heat available minus the target heat, and (iv) means for modifying a target resistance value for the cell to achieve a substantially zero heat integral in step (iii) by moving the anodes of the cell to achieve said new target resistance.

22. A system for controlling the operation of an aluminium smelting cell, comprising the steps of:

(a) means for monitoring the cell voltage and current, (b) means for monitoring alumina additions to the cell, monitoring other additions to the cell bath and monitoring operational changes such as anode movements, tapping, anode setting and beam raising, (c) means for continuously calculating the resistance of the cell, (d) means for continuously calculating the rate of change of cell resistance, and smoothing the rate of change values so calculated to continuously provide smoothed resistance slope values, (e) means for continuously monitoring cell voltage or resistance to determine the existence of low frequency noise in the voltage signal, (f) means for continuously calculating the energy absorbed by the process from thermodynamics and the events identified in item (b) above, (g) means for calculating the heat available for dissipation in the cell from the cell voltage and current and from the continuously calculated process energy requirement determined in item (f) above, (h) means for establishing a base threshold and a critical threshold for said smoothed resistance slope value indicating target and low alumina concentrations respectively, (i) means for determining whether low frequency voltage noise exists above a predetermined threshold and increasing the smoothed resistance slope threshold in the event that said low frequency voltage noise is above said threshold, (j) means for calculating the alumina inventory of the cell from the monitored alumina additions, (k) means for determining whether the smoothed resistance slope is greater than the predetermined threshold and if so determining whether the cell has been overfed from the calculated alumina inventory, and if not causing an alumina feed to occur, (l) means for calculating from the calculated heat available for dissipation and from a selected target power dissipation, the integral of the difference between the heat available and the target power dissipation with respect to time, (m) means for calculating from this heat deficit or surplus in the cell the change in power dissipation required in the cell over a predetermined period to restore heat balance (zero heat integral in item (1)), (n) means for establishing an initial target resistance and an allowable band for said target resistance, (o) means for Calculating the required change in target resistance from the required change in cell power dissipation (item (m)) divided by the square of the moving average of the cell current, (p) means for altering the target resistance in accordance with the calculated heat inventory (item (o)) and checking that the new target resistance is within said allowable band, and (q) means for moving the anodes of the cell to achieve said new target resistance.

23. A process for controlling the operation of an aluminium smelting cell comprising the steps of:

(a) maintaining the mass balance of the cell at a predetermined level by calculating and monitoring a smoothed rate of change of the resistance of the cell to detect a predetermined slope threshold indicative of low alumina concentration in the cell, and (b) maintaining the heat balance of the cell by (i) calculating a target heat dissipation for the cell, (ii) calculating a resistivity of the cell bath, (iii) monitoring the resistivity and rate of change of resistivity with time to detect values greater than predetermined limits indicative of the cell superheat being out of range, and (iv) adjusting the target heat dissipation of the cell to return the cell superheat to within a predetermined range.

24. The process of claim 23, wherein said bath resistivity is measured by measuring the resistance of the cell over a predetermined period, adjusting the anode to cathode distance by a predetermined amount, measuring the resistance of the cell over a predetermined period, and calculating the resistivity of the bath from the formula:

$$R_{TOT} = \frac{\rho\text{eff}\, ACD}{A_A} + \Sigma R_{FIXED}$$

wherein bath resistivity $$\rho\text{eff} = \frac{\delta R \cdot A_A}{\delta ACD},$$

and $\delta R = (R_{TOT})_{Final} - (R_{TOT})_{Initial}$.

25. A system for controlling the operation of an aluminum smelting cell comprising:

(i) means for continuously monitoring cell voltage and current;

(ii) means for calculating the resistance of the cell from the monitored cell voltage and current;

(iii) means for calculating the rate of change of cell resistance (resistance slope) and a smoothed value of said resistance slope, wherein the means for calculating a smoothed value of said resistance slope calculates a raw resistance slope from the equation:

$$S_0=(R_0-R_1)/(\Delta t(1+1/\gamma))$$

where $S_0$=raw slope at time $(t+\Delta t)$;

$R_0$=raw resistance at time $(t+\Delta t)$;

$R_1$=single stage filtered resistance at time t;

$\Delta t$=time interval of resistance polling;

$\gamma$=filter constant for filtered resistance $(R_1)$;

(iv) means for checking to determine whether the raw slope falls within predetermined limits and rejecting any value falling outside such limits;

(v) means for calculating the filtered resistance from the formula:

$$R_1=R_1(1-\gamma_1)+\gamma_1 R_o,$$

and for calculating a filtered resistance slope from the formula:

$$S_i=S_i(1-\gamma_i)+\gamma_i S_{i-1}$$

where $\gamma_1$ is a predetermined filter constant of the $i^{th}$ stage;

(vi) means for utilizing the smoothed resistance slope values to maintain mass balance in the cell;

(vii) means for monitoring cell process operations including alumina additions, electrolyte bath additions, anode changes, tapping, beam raising and anode beam movement;

(viii) means for delaying the calculation of resistance slope and smoothed resistance slope for a predetermined time when any one of said monitored cell process operations occurs, and (ix) means for recalculating said cell resistance slope and smoothed resistance slope after said predetermined time delay so that the smoothed slope is unaffected by process changes with the exception of alumina depletion.

26. A process for controlling the operation of an aluminum smelting cell, comprising the steps of:

(i) continuously monitoring cell voltage and current, (ii) calculating the resistance of the cell from the monitored cell voltage and current, (iii) calculating the rate of change of cell resistance (resistance slope) and a smoothed value of said resistance slope, wherein the step of calculating a smoothed value of said resistance slope includes the steps of calculating a raw resistance slope from the equation:

$$S_0=(R_0-R_1)/(\Delta t(1+1/\gamma));$$

where $S_0$=raw slope at time $(t+\Delta t)$;

$R_0$=raw resistance at time $(t+\Delta t)$;

$R_1$=single stage filtered resistance at time t;

$\Delta t$=time interval of resistance polling;

$\gamma$=filter constant for filtered resistance $(R_1)$;

checking to determine whether the raw slope falls within predetermined limits and rejecting any value falling outside such limits, calculating the filtered resistance from the formula:

$$R_1=R_1(1-\gamma_1)+\gamma_1 R_o;$$

and calculating a filtered resistance slope from the formula:

$$S_i=S_i(1-\gamma_i)+\gamma_i S_{i-1}$$

where $\gamma_1$ is a predetermined filter constant of the $i^{th}$ stage, and (iv) maintaining the mass balance in the cell by utilizing the smoothed resistance slope values.

27. The process of claim 26, wherein said raw resistance slope is calculated at a high frequency.

28. A process for controlling the operation of an aluminum smelting cell, comprising the steps of:

(i) continuously monitoring cell voltage and current, (ii) calculating the resistance of the cell from the monitored cell voltage and current, (iii) calculating the rate of change of cell resistance (resistance slope) and a smoothed value of said resistance slope, wherein the step of calculating a smoothed value of said resistance slope includes the steps of calculating a raw resistance slope from the equation:

$$S_0=(R_0-R_1)/(\Delta t(1+1/\gamma))$$

where $S_0$=raw slope at time $(t+\Delta t)$;

$R_0$=raw resistance at time $(t+\Delta t)$;

$R_1$=single stage filtered resistance at time t;

$\Delta t$=time interval of resistance polling;

$\gamma$=filter constant for filtered resistance $(R_1)$;

checking to determine whether the raw slope falls within predetermined limits, and rejecting any value falling outside such limits; calculating the filtered resistance from the formula:

$$R_1=R_1(1-\gamma_1)+\gamma_1 R_o,$$

and calculating a filtered resistance slope from the formula:

$$S_i=S_i(1-\gamma_i)+\gamma_i S_{i-1}$$

where $\gamma_1$ is a predetermined filter constant of the $i^{th}$ stage;

(iv) maintaining the mass balance in the cell by utilizing the smoothed resistance slope values, (v) monitoring cell process operations, including alumina additions, electrolyte bath additions, anode changes, tapping, beam raising and anode beam movement, (vi) delaying the calculation of resistance slope and smoothed resistance slope for a predetermined time when any one of said monitored cell process operations occurs, and (vii) recalculating said cell resistance slope and smoothed resistance slope after said predetermined time delay so that the smoothed slope is unaffected by process changes with the exception of alumina depletion.

29. The process of claim 28 wherein step (iv) includes the step of searching the smoothed resistance slope for values exceeding a predetermined slope chosen to indicate alumina depletion.

30. The process of claim 28, wherein said raw resistance slope is calculated at a high frequency.

31. A process for maintaining the heat balance in an aluminum smelting cell within a predetermined range comprising:

(a) operating the cell at a predefined power input;

(b) calculating the resistivity of the cell bath;

(c) monitoring changes in the resistivity and the rate of change of resistivity over time to detect any values indicating that the cell superheat is out of range, and (d) adjusting the power input to the cell to return the cell superheat to the predetermined range.

32. The process of claim 31, wherein said raw resistance slope is calculated at a frequency of about 1 Hz.

* * * * *